US008312999B2

(12) United States Patent
Hardy

(10) Patent No.: US 8,312,999 B2
(45) Date of Patent: Nov. 20, 2012

(54) PRODUCT MANAGEMENT DISPLAY SYSTEM WITH TRACKLESS PUSHER MECHANISM

(75) Inventor: Stephen Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

(21) Appl. No.: 11/760,196

(22) Filed: Jun. 8, 2007

(65) Prior Publication Data

US 2007/0251900 A1 Nov. 1, 2007

Related U.S. Application Data

(63) Continuation-in-part of application No. 11/411,761, filed on Apr. 25, 2006, now Pat. No. 7,823,734.

(60) Provisional application No. 60/716,362, filed on Sep. 12, 2005, provisional application No. 60/734,692, filed on Nov. 8, 2005.

(51) Int. Cl.
*A47F 1/04* (2006.01)
*A47F 7/00* (2006.01)

(52) U.S. Cl. ..... 211/59.3

(58) Field of Classification Search ..... 211/59.3, 211/51, 59.2, 126.1, 162, 126.3, 184; 312/61, 312/71

See application file for complete search history.

(56) References Cited

U.S. PATENT DOCUMENTS 153,227 A 7/1874 Walker
154,940 A 9/1874 Adams
355,511 A 1/1887 Danner
551,642 A 12/1895 Kleine
(Continued)

FOREIGN PATENT DOCUMENTS

BE 906083 4/1987
(Continued)

OTHER PUBLICATIONS

Supplementary European Search Report dated Jun. 18, 2009.
(Continued)

*Primary Examiner* — Jennifer E. Novosad
(74) *Attorney, Agent, or Firm* — Banner & Witcoff, Ltd

(57) ABSTRACT

A product management display system for merchandising product on a shelf includes using a trackless pusher mechanism that travels along a surface on which product is placed. The pusher mechanism of the invention also includes a pusher paddle and a floor that extends forward of the pusher paddle. A flat coiled spring or other biasing element may be operatively connected behind the pusher paddle and extend across the floor of the pusher mechanism and to the front of the shelf. In use, the product to be merchandised may be placed on the coiled spring and on the floor of the pusher mechanism. With this configuration, the pusher paddle is prevented from tipping or bending backwards during operation. In an alternative aspect, a mounting member may be used to mount the end of the coiled spring to the floor of the system. For those systems that include spaced-apart glide rails that are joined together by connecting ribs, or that use wire shelves, the mounting member may be snap-fit to or otherwise mounted on the floor and between the glide rails or shelf wires. The invention may be used with the merchandising of product on horizontal or non-inclined shelves or surfaces, as well as with gravity-fed systems, or systems that use gravity as a mechanism to urge product toward the front of the shelf.

33 Claims, 15 Drawing Sheets

U.S. PATENT DOCUMENTS

| | | | | |
|---|---|---|---|---|
| 632,231 | A | | 9/1899 | Blades |
| 808,067 | A | | 12/1905 | Briggs |
| 847,863 | A | | 3/1907 | Watts |
| 1,030,317 | A | | 6/1912 | Middaugh |
| 1,156,140 | A | | 10/1915 | Hair |
| 1,271,508 | A | | 7/1918 | Hall |
| 1,674,582 | A | | 6/1928 | Wheeler |
| 1,703,987 | A | | 3/1929 | Butler |
| 1,712,080 | A | | 5/1929 | Kelly |
| 1,714,266 | A | | 5/1929 | Johnson |
| 1,734,031 | A | | 11/1929 | Carlson |
| 1,910,516 | A | | 5/1933 | Besenberg et al. |
| 1,964,597 | A | | 6/1934 | Rapellin |
| 1,971,749 | A | | 8/1934 | Hamilton |
| 1,991,102 | A | | 2/1935 | Kemaghan |
| 2,013,284 | A | | 9/1935 | Michaud |
| 2,057,627 | A | | 10/1936 | Ferris |
| 2,076,941 | A | | 4/1937 | Farr |
| 2,079,754 | A | | 5/1937 | Waxgiser |
| 2,085,479 | A | | 6/1937 | Shaffer et al. |
| 2,110,299 | A | | 3/1938 | Hinkle |
| 2,111,496 | A | | 3/1938 | Scriba |
| 2,129,122 | A | | 9/1938 | Follett |
| 2,218,444 | A | | 10/1940 | Vineyard |
| 2,284,849 | A | | 6/1942 | Schreyer |
| 2,308,851 | A | | 1/1943 | Anderson |
| 2,499,088 | A | | 2/1950 | Brill et al. |
| 2,516,122 | A | | 7/1950 | Hughes |
| 2,538,908 | A | | 1/1951 | McKeehan |
| 2,555,102 | A | | 5/1951 | Anderson |
| 2,563,570 | A | | 8/1951 | Williams |
| 2,652,154 | A | | 9/1953 | Stevens |
| 2,670,853 | A | | 3/1954 | Schneider |
| 2,678,045 | A | | 5/1954 | Erhard |
| 2,738,881 | A | | 3/1956 | Michel |
| 2,838,881 | A | | 3/1956 | Michel |
| 2,750,049 | A | | 6/1956 | Hunter |
| 2,775,365 | A | | 12/1956 | Mestman et al. |
| 2,893,596 | A | | 7/1959 | Gabrielsen |
| 2,918,295 | A | | 12/1959 | Milner |
| 2,934,212 | A | | 4/1960 | Jacobson |
| 2,948,403 | A | | 8/1960 | Vallez |
| 3,083,067 | A | * | 3/1963 | Vos et al. ..... 312/71 |
| 3,103,396 | A | | 9/1963 | Portnoy |
| 3,110,402 | A | * | 11/1963 | Mogulescu ..... 211/59.3 |
| 3,151,576 | A | | 10/1964 | Patterson |
| 3,161,295 | A | | 12/1964 | Chesley |
| 3,166,195 | A | | 1/1965 | Taber |
| 3,285,429 | A | | 11/1966 | Propst |
| 3,308,961 | A | | 3/1967 | Chesley |
| 3,308,964 | A | | 3/1967 | Pistone |
| 3,348,732 | A | | 10/1967 | Schwarz |
| 3,405,716 | A | | 10/1968 | Cafiero et al. |
| 3,452,899 | A | | 7/1969 | Libberton |
| 3,497,081 | A | | 2/1970 | Field |
| 3,501,020 | A | | 3/1970 | Krikorian |
| D219,058 | S | | 10/1970 | Kaczur |
| 3,550,979 | A | | 12/1970 | Protzmann |
| 3,598,246 | A | | 8/1971 | Galli |
| 3,652,154 | A | | 3/1972 | Gebel |
| 3,667,826 | A | | 6/1972 | Wood et al. |
| 3,698,568 | A | | 10/1972 | Armstrong |
| 3,709,371 | A | | 1/1973 | Luck |
| 3,751,129 | A | | 8/1973 | Wright et al. |
| 3,780,876 | A | | 12/1973 | Elkins |
| 3,814,490 | A | | 6/1974 | Dean et al. |
| 3,815,519 | A | | 6/1974 | Meyer |
| 3,830,169 | A | | 8/1974 | Madey |
| 3,848,745 | A | | 11/1974 | Smith |
| 3,868,021 | A | | 2/1975 | Heinrich |
| 3,870,156 | A | | 3/1975 | O'Neill |
| 3,960,273 | A | | 6/1976 | Weston |
| 4,007,841 | A | | 2/1977 | Seipel |
| 4,015,886 | A | | 4/1977 | Wickenberg |
| 4,042,096 | A | | 8/1977 | Smith |
| 4,106,668 | A | | 8/1978 | Gebhardt et al. |
| 4,205,763 | A | | 6/1980 | Merl |
| 4,269,326 | A | | 5/1981 | Delbrouck |
| 4,300,693 | A | | 11/1981 | Spamer |
| 4,303,162 | A | | 12/1981 | Suttles |
| 4,314,700 | A | | 2/1982 | Dylag |
| 4,331,243 | A | | 5/1982 | Doll |
| 4,351,439 | A | | 9/1982 | Taylor |
| 4,378,872 | A | | 4/1983 | Brown |
| 4,397,606 | A | | 8/1983 | Bruton |
| 4,416,380 | A | | 11/1983 | Flum |
| 4,448,653 | A | | 5/1984 | Wegmann |
| 4,454,948 | A | | 6/1984 | Spamer |
| 4,454,949 | A | | 6/1984 | Flum |
| 4,460,096 | A | | 7/1984 | Ricci |
| D275,058 | S | | 8/1984 | Flum |
| 4,463,854 | A | | 8/1984 | MacKenzie |
| 4,467,927 | A | | 8/1984 | Nathan |
| 4,470,943 | A | | 9/1984 | Preis |
| 4,478,337 | A | | 10/1984 | Flum |
| 4,482,066 | A | | 11/1984 | Dykstra |
| 4,488,653 | A | | 12/1984 | Belokin |
| 4,504,100 | A | | 3/1985 | Chaumard |
| 4,588,093 | A | | 5/1986 | Field |
| 4,589,349 | A | | 5/1986 | Gebhardt et al. |
| 4,590,696 | A | | 5/1986 | Squitieri |
| 4,593,823 | A | | 6/1986 | Fershko et al. |
| 4,602,560 | A | | 7/1986 | Jacky |
| 4,615,276 | A | | 10/1986 | Garabedian |
| 4,620,489 | A | | 11/1986 | Albano |
| 4,629,072 | A | | 12/1986 | Loew |
| 4,651,883 | A | | 3/1987 | Gullett et al. |
| 4,685,574 | A | | 8/1987 | Young et al. |
| 4,705,175 | A | | 11/1987 | Howard et al. |
| 4,706,821 | A | | 11/1987 | Kohls et al. |
| 4,712,694 | A | | 12/1987 | Breslow |
| 4,724,968 | A | | 2/1988 | Wombacher |
| 4,729,481 | A | | 3/1988 | Hawkinson et al. |
| 4,730,741 | A | | 3/1988 | Jackle, III et al. |
| 4,742,936 | A | | 5/1988 | Rein |
| 4,762,235 | A | | 8/1988 | Howard et al. |
| 4,762,236 | A | | 8/1988 | Jackle, III et al. |
| 4,771,898 | A | | 9/1988 | Howard et al. |
| 4,775,058 | A | | 10/1988 | Yatsko |
| 4,776,472 | A | | 10/1988 | Rosen |
| 4,790,037 | A | | 12/1988 | Phillips |
| 4,801,025 | A | | 1/1989 | Flum et al. |
| 4,809,855 | A | | 3/1989 | Bustos |
| 4,809,856 | A | | 3/1989 | Muth |
| 4,828,144 | A | | 5/1989 | Garrick |
| 4,830,201 | A | | 5/1989 | Breslow |
| 4,836,390 | A | | 6/1989 | Polvere |
| 4,846,367 | A | | 7/1989 | Guigan et al. |
| 4,883,169 | A | | 11/1989 | Flanagan, Jr. |
| 4,887,737 | A | | 12/1989 | Adenau |
| 4,896,779 | A | | 1/1990 | Jureckson |
| 4,899,668 | A | | 2/1990 | Valiulis |
| 4,899,893 | A | * | 2/1990 | Robertson ..... 211/59.3 |
| 4,901,853 | A | | 2/1990 | Maryatt |
| 4,901,869 | A | | 2/1990 | Hawkinson et al. |
| 4,907,707 | A | | 3/1990 | Crum |
| 4,923,070 | A | | 5/1990 | Jackle et al. |
| 4,934,645 | A | | 6/1990 | Breslow |
| 4,958,739 | A | | 9/1990 | Spamer |
| RE33,515 | E | | 1/1991 | Fershko et al. |
| 4,997,094 | A | | 3/1991 | Spamer et al. |
| 5,012,936 | A | | 5/1991 | Crum |
| 5,024,336 | A | | 6/1991 | Spamer |
| 5,025,936 | A | | 6/1991 | Lamoureaux |
| 5,027,957 | A | | 7/1991 | Skalski |
| 5,082,125 | A | | 1/1992 | Ninni |
| 5,088,607 | A | | 2/1992 | Risafi et al. |
| 5,110,192 | A | | 5/1992 | Lauterbach |
| 5,111,942 | A | | 5/1992 | Bemardin |
| 5,123,546 | A | | 6/1992 | Crum |
| 5,148,927 | A | | 9/1992 | Gebka |
| 5,159,753 | A | | 11/1992 | Torrence |
| 5,161,702 | A | | 11/1992 | Skalski |
| 5,161,704 | A | | 11/1992 | Valiulis |
| 5,178,258 | A | | 1/1993 | Smalley |
| 5,183,166 | A | | 2/1993 | Belokin, Jr. et al. |
| 5,190,186 | A | | 3/1993 | Yablans et al. |

5,197,610 A 3/1993 Bustos
5,203,463 A 4/1993 Gold
5,215,199 A 6/1993 Bejarano
5,255,802 A 10/1993 Krinke et al.
5,265,738 A 11/1993 Yablans et al.
5,295,596 A 3/1994 Squitieri
5,316,154 A 5/1994 Hajec, Jr.
5,341,945 A 8/1994 Gibson
5,351,839 A 10/1994 Beeler et al.
5,366,099 A 11/1994 Schmid
5,381,908 A 1/1995 Hepp
5,390,802 A 2/1995 Pappagallo et al.
5,397,016 A 3/1995 Torrence et al.
5,405,193 A 4/1995 Herrenbruck
5,413,229 A 5/1995 Zuberbuhler et al.
5,415,297 A 5/1995 Klein et al.
5,439,122 A 8/1995 Ramsay
5,450,969 A 9/1995 Johnson et al.
5,458,248 A 10/1995 Alain
5,464,105 A 11/1995 Mandeltort
5,469,975 A 11/1995 Fajnsztajn
5,469,976 A 11/1995 Burchell
5,505,315 A 4/1996 Carroll
5,542,552 A 8/1996 Yablans et al.
5,562,217 A 10/1996 Salveson et al.
5,597,150 A 1/1997 Stein et al.
5,613,621 A 3/1997 Gervasi
D378,888 S 4/1997 Bertilsson
5,615,780 A 4/1997 Nimetz et al.
5,634,564 A * 6/1997 Spamer et al. ..... 211/59.3
5,638,963 A 6/1997 Finnelly et al.
5,641,082 A 6/1997 Grainger
5,645,176 A 7/1997 Jay
5,657,702 A 8/1997 Ribeyrolles
5,665,304 A 9/1997 Heinen et al.
5,673,801 A 10/1997 Markson
D386,363 S 11/1997 Dardashti
5,682,824 A 11/1997 Visk
5,685,664 A 11/1997 Parham et al.
5,695,076 A 12/1997 Jay
5,695,077 A 12/1997 Jay
5,707,034 A 1/1998 Cotterill
5,711,432 A 1/1998 Stein et al.
5,720,230 A 2/1998 Mansfield
5,730,320 A 3/1998 David
5,738,019 A 4/1998 Parker
5,740,944 A 4/1998 Crawford
5,743,428 A 4/1998 Rankin, VI
5,746,328 A 5/1998 Beeler et al.
5,749,478 A 5/1998 Ellis
5,788,090 A 8/1998 Kajiwara
5,803,276 A 9/1998 Vogler
5,826,731 A 10/1998 Dardashti
5,839,588 A 11/1998 Hawkinson
D402,490 S 12/1998 Parham
5,848,709 A 12/1998 Gelphman et al.
5,855,283 A 1/1999 Johnson
5,865,324 A 2/1999 Jay et al.
5,873,473 A 2/1999 Pater
5,873,489 A 2/1999 Ide et al.
5,878,895 A 3/1999 Springs
5,887,732 A 3/1999 Zimmer et al.
5,904,256 A 5/1999 Jay
5,906,283 A 5/1999 Kump et al.
5,944,201 A 8/1999 Babboni et al.
5,970,887 A 10/1999 Hardy
5,971,173 A 10/1999 Valiulis et al.
5,971,204 A 10/1999 Apps
5,975,318 A 11/1999 Jay
5,992,652 A 11/1999 Springs
6,006,678 A 12/1999 Merit
6,021,908 A 2/2000 Mathews
6,026,984 A 2/2000 Perrin
6,041,720 A 3/2000 Hardy
6,068,142 A 5/2000 Primiano
6,082,556 A 7/2000 Primiano et al.
6,082,557 A 7/2000 Leahy
6,112,938 A 9/2000 Apps
6,129,218 A 10/2000 Henry et al.
6,142,317 A * 11/2000 Merl ..... 211/59.3
6,164,462 A 12/2000 Mumford
6,164,491 A 12/2000 Bustos et al.
6,173,845 B1 1/2001 Higgins et al.
6,209,731 B1 4/2001 Spamer et al.
6,209,733 B1 4/2001 Higgins et al.
6,227,385 B1 5/2001 Nickerson
6,234,325 B1 5/2001 Higgins et al.
6,234,326 B1 5/2001 Higgins et al.
6,234,328 B1 5/2001 Mason
D445,615 S 7/2001 Burke
6,253,954 B1 7/2001 Yasaka
6,299,004 B1 10/2001 Thalenfeld et al.
6,305,559 B1 10/2001 Hardy
6,308,839 B1 10/2001 Steinberg et al.
6,311,852 B1 11/2001 Ireland
6,325,221 B2 12/2001 Parham
6,330,758 B1 12/2001 Feibelman
6,357,606 B1 3/2002 Henry
6,375,015 B1 4/2002 Wingate
6,382,431 B1 5/2002 Burke
6,398,044 B1 6/2002 Robertson
6,401,942 B1 6/2002 Eckert
6,405,880 B1 6/2002 Webb
6,409,027 B1 6/2002 Chang et al.
6,409,028 B2 6/2002 Nickerson
6,419,100 B1 7/2002 Menz et al.
6,428,123 B1 8/2002 Lucht et al.
6,435,359 B1 8/2002 Priminano
6,439,402 B2 8/2002 Robertson
6,464,089 B1 10/2002 Rankin, VI
6,471,053 B1 10/2002 Feibelman
6,484,891 B2 11/2002 Burke
6,497,326 B1 12/2002 Osawa
6,505,747 B1 1/2003 Robertson
6,523,702 B1 2/2003 Primiano et al.
6,523,703 B1 2/2003 Robertson
6,527,127 B2 3/2003 Dumontet
6,533,131 B2 3/2003 Bada
D472,411 S 4/2003 Burke
6,554,143 B1 4/2003 Robertson
6,604,638 B1 8/2003 Primiano et al.
6,615,995 B2 9/2003 Primiano et al.
6,622,874 B1 9/2003 Hawkinson
6,637,604 B1 10/2003 Jay
6,655,536 B2 12/2003 Jo et al.
6,659,293 B1 12/2003 Smith
6,666,533 B1 12/2003 Stavros
D485,699 S 1/2004 Mueller et al.
6,679,033 B2 1/2004 Hart et al.
6,679,389 B1 1/2004 Robertson et al.
6,695,152 B1 2/2004 Fabrizio et al.
6,715,621 B2 4/2004 Boron
6,722,509 B1 4/2004 Robertson et al.
6,745,905 B2 6/2004 Bernstein
6,756,975 B1 6/2004 Kishida et al.
6,758,349 B1 7/2004 Kwap et al.
6,772,888 B2 8/2004 Burke
6,779,670 B2 8/2004 Primiano et al.
6,796,445 B2 9/2004 Cyrluk
6,799,523 B1 10/2004 Cunha
6,843,382 B2 1/2005 Kanouchi et al.
6,860,046 B1 3/2005 Squitieri
6,866,156 B2 3/2005 Nagel et al.
6,867,824 B2 3/2005 Eiraku et al.
6,874,646 B2 4/2005 Jay
6,889,854 B2 5/2005 Burke
6,889,855 B2 * 5/2005 Nagel ..... 211/59.3
6,902,285 B2 6/2005 Eiraku et al.
6,918,736 B2 7/2005 Hart et al.
6,919,933 B2 7/2005 Zhang et al.
6,929,133 B1 8/2005 Knapp, III et al.
6,948,900 B1 9/2005 Neuman
6,955,269 B2 10/2005 Menz
6,957,941 B2 10/2005 Hart et al.
6,962,260 B2 11/2005 Jay et al.
6,963,386 B2 11/2005 Poliakine et al.
6,964,235 B2 11/2005 Hardy
6,964,344 B1 11/2005 Kim

| | | | | |
|---|---|---|---|---|
| 6,976,598 | B2 | 12/2005 | Engel | |
| 6,981,597 | B2 | 1/2006 | Cash | |
| 7,004,334 | B2 | 2/2006 | Walsh et al. | |
| 7,028,450 | B2 | 4/2006 | Hart et al. | |
| 7,028,852 | B2 | 4/2006 | Johnson et al. | |
| 7,080,969 | B2 | 7/2006 | Hart et al. | |
| 7,083,054 | B2 | 8/2006 | Squitieri | |
| 7,086,541 | B2 | 8/2006 | Robertson | |
| 7,093,546 | B2 | 8/2006 | Hardy | |
| 7,104,026 | B2 | 9/2006 | Welborn et al. | |
| 7,108,143 | B1 | 9/2006 | Lin | |
| 7,124,898 | B2 | 10/2006 | Richter et al. | |
| 7,140,499 | B2 | 11/2006 | Burke | |
| 7,140,705 | B2 | 11/2006 | Dressendorfer et al. | |
| 7,150,365 | B2 | 12/2006 | Hardy et al. | |
| 7,152,536 | B2 | 12/2006 | Hardy | |
| 7,168,579 | B2 | 1/2007 | Richter et al. | |
| 7,182,209 | B2 | 2/2007 | Squitieri | |
| 7,195,123 | B2 * | 3/2007 | Roslof et al. | 211/59.3 |
| 7,201,281 | B1 * | 4/2007 | Welker | 211/59.3 |
| 7,216,770 | B2 | 5/2007 | Mueller | |
| 7,293,663 | B2 * | 11/2007 | Lavery, Jr. | 211/59.3 |
| 7,299,934 | B2 | 11/2007 | Hardy et al. | |
| 1,786,392 | A1 | 4/2008 | Kemp | |
| 7,395,938 | B2 | 7/2008 | Merit et al. | |
| 7,451,881 | B2 | 11/2008 | Hardy et al. | |
| 7,458,473 | B1 | 12/2008 | Mason | |
| 7,681,743 | B2 | 3/2010 | Hanretty et al. | |
| 7,703,614 | B2 | 4/2010 | Schneider et al. | |
| 7,708,154 | B2 * | 5/2010 | Lang et al. | 211/59.3 |
| 7,918,353 | B1 | 4/2011 | Luberto | |
| 7,934,609 | B2 | 5/2011 | Alves et al. | |
| 8,016,139 | B2 | 9/2011 | Hanners et al. | |
| 8,025,162 | B2 | 9/2011 | Hardy | |
| 8,113,360 | B2 | 2/2012 | Olson | |
| 2001/0010302 | A1 | 8/2001 | Nickerson | |
| 2001/0019032 | A1 | 9/2001 | Battaglia et al. | |
| 2001/0042706 | A1 | 11/2001 | Ryan, Jr. et al. | |
| 2001/0045403 | A1 | 11/2001 | Robertson | |
| 2002/0036178 | A1 | 3/2002 | Tombu | |
| 2002/0066706 | A1 | 6/2002 | Robertson | |
| 2002/0108916 | A1 | 8/2002 | Nickerson | |
| 2002/0148794 | A1 | 10/2002 | Marihugh | |
| 2002/0170866 | A1 | 11/2002 | Johnson et al. | |
| 2002/0179553 | A1 | 12/2002 | Squitieri | |
| 2002/0182050 | A1 | 12/2002 | Hart et al. | |
| 2002/0189201 | A1 | 12/2002 | Hart et al. | |
| 2002/0189209 | A1 | 12/2002 | Hart et al. | |
| 2003/0000956 | A1 | 1/2003 | Maldonado | |
| 2003/0007859 | A1 | 1/2003 | Hart et al. | |
| 2003/0010732 | A1 | 1/2003 | Burke | |
| 2003/0057167 | A1 | 3/2003 | Johnson et al. | |
| 2003/0061973 | A1 | 4/2003 | Bustos | |
| 2003/0080075 | A1 | 5/2003 | Primiano et al. | |
| 2003/0085187 | A1 | 5/2003 | Johnson et al. | |
| 2003/0132178 | A1 | 7/2003 | Jay et al. | |
| 2003/0132182 | A1 | 7/2003 | Jay | |
| 2003/0136750 | A1 | 7/2003 | Fujii et al. | |
| 2003/0141265 | A1 * | 7/2003 | Jo et al. | 211/59.3 |
| 2003/0168420 | A1 | 9/2003 | Primiano | |
| 2003/0217980 | A1 | 11/2003 | Johnson et al. | |
| 2004/0000528 | A1 | 1/2004 | Nagel | |
| 2004/0004046 | A1 | 1/2004 | Primiano et al. | |
| 2004/0079715 | A1 | 4/2004 | Richter et al. | |
| 2004/0084390 | A1 | 5/2004 | Bernstein | |
| 2004/0094493 | A1 | 5/2004 | Higgins | |
| 2004/0104239 | A1 | 6/2004 | Black, Jr. et al. | |
| 2004/0140278 | A1 | 7/2004 | Mueller et al. | |
| 2004/0140279 | A1 | 7/2004 | Mueller et al. | |
| 2004/0178157 | A1 * | 9/2004 | Tse | 211/59.3 |
| 2004/0182805 | A1 | 9/2004 | Harper | |
| 2004/0206054 | A1 | 10/2004 | Welborn et al. | |
| 2004/0232092 | A1 | 11/2004 | Cash | |
| 2004/0245197 | A1 | 12/2004 | McElvaney | |
| 2005/0040123 | A1 | 2/2005 | Ali | |
| 2005/0072747 | A1 | 4/2005 | Roslof et al. | |
| 2005/0076817 | A1 | 4/2005 | Boks et al. | |
| 2005/0098515 | A1 | 5/2005 | Close | |
| 2005/0127014 | A1 | 6/2005 | Richter et al. | |
| 2005/0133471 | A1 | 6/2005 | Squitieri | |
| 2005/0167377 | A1 * | 8/2005 | Robertson | 211/59.3 |
| 2005/0189310 | A1 | 9/2005 | Richter et al. | |
| 2005/0199563 | A1 | 9/2005 | Richter et al. | |
| 2005/0199564 | A1 | 9/2005 | Johnson et al. | |
| 2005/0199565 | A1 | 9/2005 | Richter et al. | |
| 2005/0224437 | A1 | 10/2005 | Lee | |
| 2005/0249577 | A1 | 11/2005 | Hart et al. | |
| 2005/0263465 | A1 | 12/2005 | Chung | |
| 2005/0279722 | A1 * | 12/2005 | Ali | 211/59.3 |
| 2006/0001337 | A1 | 1/2006 | Walburn | |
| 2006/0032827 | A1 | 2/2006 | Phoy | |
| 2006/0049122 | A1 | 3/2006 | Mueller et al. | |
| 2006/0049125 | A1 | 3/2006 | Stowell | |
| 2006/0076301 | A1 * | 4/2006 | Caterinacci et al. | 211/59.3 |
| 2006/0104758 | A1 | 5/2006 | Hart et al. | |
| 2006/0163272 | A1 | 7/2006 | Gamble | |
| 2006/0186064 | A1 | 8/2006 | Merit et al. | |
| 2006/0186066 | A1 | 8/2006 | Johnson et al. | |
| 2006/0196840 | A1 | 9/2006 | Jay et al. | |
| 2006/0213852 | A1 | 9/2006 | Kwon | |
| 2006/0226095 | A1 | 10/2006 | Hardy | |
| 2006/0237381 | A1 | 10/2006 | Lockwood et al. | |
| 2006/0260518 | A1 | 11/2006 | Josefsson et al. | |
| 2006/0263192 | A1 | 11/2006 | Hart et al. | |
| 2006/0273053 | A1 | 12/2006 | Roslof et al. | |
| 2006/0283150 | A1 | 12/2006 | Hart et al. | |
| 2006/0283151 | A1 | 12/2006 | Welborn et al. | |
| 2007/0090068 | A1 * | 4/2007 | Hardy | 211/59.3 |
| 2007/0170127 | A1 | 7/2007 | Johnson | |
| 2007/0175839 | A1 | 8/2007 | Schneider et al. | |
| 2007/0175844 | A1 | 8/2007 | Schneider | |
| 2008/0011696 | A1 | 1/2008 | Richter et al. | |
| 2008/0142458 | A1 * | 6/2008 | Medcalf | 211/59.3 |
| 2008/0156751 | A1 | 7/2008 | Richter et al. | |
| 2008/0156752 | A1 | 7/2008 | Bryson et al. | |
| 2008/0164229 | A1 | 7/2008 | Richter et al. | |
| 2008/0314852 | A1 | 12/2008 | Richter et al. | |
| 2010/0025346 | A1 * | 2/2010 | Crawbuck et al. | 211/59.3 |
| 2010/0089847 | A1 * | 4/2010 | Rataiczak et al. | 211/59.3 |
| 2010/0096345 | A1 * | 4/2010 | Crawbuck et al. | 211/59.3 |
| 2010/0108624 | A1 * | 5/2010 | Sparkowski | 211/59.3 |
| 2010/0252519 | A1 | 10/2010 | Hanners et al. | |
| 2010/0276383 | A1 * | 11/2010 | Hardy | 211/59.3 |
| 2011/0017684 | A1 * | 1/2011 | Nagel et al. | 211/59.3 |
| 2011/0049067 | A1 * | 3/2011 | Garson et al. | 211/59.3 |
| 2011/0168652 | A1 * | 7/2011 | Barkdoll | 211/59.3 |
| 2011/0174750 | A1 | 7/2011 | Poulokefalos | |
| 2011/0210086 | A1 * | 9/2011 | Ciesick | 211/59.3 |
| 2011/0215061 | A1 * | 9/2011 | Niederhuefner et al. | 211/59.3 |
| 2012/0080392 | A1 * | 4/2012 | Gelardi et al. | 211/59.3 |
| 2012/0118840 | A1 * | 5/2012 | Howley | 211/59.3 |

FOREIGN PATENT DOCUMENTS

| | | | |
|---|---|---|---|
| BE | 1013877 | | 11/2002 |
| CH | 412251 | | 4/1966 |
| DE | 969003 | | 4/1958 |
| DE | 1819158 | | 7/1960 |
| DE | 2002720 | | 7/1971 |
| DE | 2232398 | | 1/1974 |
| DE | 2825724 | A1 | 12/1979 |
| DE | 8308485 | | 9/1983 |
| DE | 8426651 | | 7/1985 |
| DE | 8717386.7 | U1 | 4/1988 |
| DE | 3707410 | A1 | 9/1988 |
| DE | 9300431.1 | | 6/1993 |
| DE | 29618870 | U1 | 1/1997 |
| DE | 29902688 | | 7/1999 |
| DE | 7311113 | | 2/2009 |
| EP | 0004921 | | 4/1979 |
| EP | 0018003 | | 7/1984 |
| EP | 0176209 | | 4/1986 |
| EP | 0224107 | A2 | 11/1986 |
| EP | 270016 | | 6/1988 |
| EP | 0337340 | | 10/1989 |
| EP | 0408400 | A1 | 7/1990 |
| EP | 0398500 | A1 | 11/1990 |
| EP | 0454586 | B1 | 10/1991 |
| EP | 0568396 | A1 | 11/1993 |

| | | | |
|---|---|---|---|
| EP | 0587059 | A2 | 3/1994 |
| EP | 986980 | | 3/2000 |
| EP | 0779047 | B1 | 4/2000 |
| EP | 1395152 | | 2/2005 |
| EP | 1857021 | A1 | 11/2007 |
| FR | 2385365 | | 10/1978 |
| FR | 2526338 | | 11/1983 |
| FR | 2617385 | | 1/1989 |
| GB | 697994 | | 10/1953 |
| GB | 740311 | | 11/1955 |
| GB | 881700 | | 11/1961 |
| GB | 1082150 | | 9/1967 |
| GB | 2027339 | A | 2/1980 |
| GB | 2037553 | | 7/1994 |
| GB | 2281289 | | 1/1995 |
| GB | 2283407 | A | 5/1995 |
| GB | 2290077 | | 12/1995 |
| GB | 2297241 | A | 7/1996 |
| GB | 2392667 | A | 3/2004 |
| GB | 1088654 | | 4/2008 |
| JP | 54168195 | | 11/1979 |
| JP | 59 218113 | | 8/1984 |
| JP | 62060521 | A | 3/1987 |
| JP | 6329463 | | 2/1988 |
| JP | 63-97114 | A | 4/1988 |
| JP | 1-86856 | U | 6/1989 |
| JP | 02-191413 | | 7/1990 |
| JP | 3-45766 | U | 4/1991 |
| JP | 4-23463 | U | 2/1992 |
| JP | 6202945 | | 7/1994 |
| JP | 6-77614 | U | 11/1994 |
| JP | 9-238787 | A | 9/1997 |
| JP | 11-18889 | A | 1/1999 |
| JP | 11342054 | | 12/1999 |
| JP | 2000157378 | | 6/2000 |
| JP | 2000350642 | | 12/2000 |
| JP | 2001104117 | | 4/2001 |
| JP | 2003210286 | | 7/2003 |
| JP | 3099639 | U | 11/2003 |
| JP | 3115812 | U | 10/2005 |
| JP | 4708539 | B2 | 3/2011 |
| NL | 106617 | | 11/1963 |
| NL | 8520125 | | 1/1986 |
| NL | 1018330 | | 7/2002 |
| SE | 394537 | | 6/1977 |
| SU | 1600615 | A3 | 6/1987 |
| SU | 1600615 | | 10/1990 |
| WO | 9115141 | A | 10/1991 |
| WO | 9201614 | | 2/1992 |
| WO | 0071004 | | 11/2000 |
| WO | 0291885 | | 11/2002 |
| WO | 03/013316 | A3 | 2/2003 |
| WO | 03032775 | A2 | 4/2003 |
| WO | 2004105556 | A | 12/2004 |
| WO | 2006094058 | | 8/2006 |
| WO | 2007/073294 | A1 | 6/2007 |
| WO | 2008/153561 | A1 | 12/2008 |

OTHER PUBLICATIONS

International Search Report dated Aug. 27, 2008.

FFr Yello Pages ® Product Catalog, "Merchandising Ideas Made Easy for Every Retail Environment", Cover p. 9-11, 48-49, 52-58, Back Cover.

*RTC Ind* v. *William Merit & Assoc.*, United States District Court Northern District of Illinois (Chicago), Case #:1:04-cv-01254.

*RTC Ind* v. *Fasteners For Retail*, et al., United States District Court Northern District of Illinois (Chicago), Case #:1:03-cv-03137.

*RTC Ind* v. *HMG Worldwide Corp.*, United States District Court Northern District of Illinois (Chicago), Case #:1:00-cv-03300.

*RTC Ind* v. *Display Specialties*, United States District Court Northern District of Illinois (Chicago), Case #:1:04-cv-03370.

*RTC Ind* v. *Semasys Inc.*, et al., United States District Court Northern District of Illinois (Chicago), Case #:1:04-cv-04081.

*RTC Ind* v. *Fasteners for Retail*, et al., United States District Court Northern District of Illinois (Chicago), Case #:1:05-cv-06940.

*VIDPRO International Inc.* v. *RTC Industries, Inc.*, U.S. District Court Northern District of Texas (Dallas), Case #:3:95-cv-01055-G.

*RTC Industries, Inc.*, v. *Fasteners for Retail, Inc.*, and SuperValu, Inc. d/b/a Cub Foods, Stipulation of Dismissal, Civil Action No. 05 C 6940, Apr. 2006.

*RTC* vs. *Fasteners for Retail*, Case No. 05C 6940, Document No. 26, filed Apr. 25, 2006.

*RTC Industries, Inc.*, v. *HMG Worldwide Corporation*, Complaint, Civil Action No. 00C 3300, dated May 31, 2000.

*RTC Industries, Inc.* v. *HMG Worldwide Corporation*, Amended Complaint, dated Jan. 19, 2001.

*RTC Industries, Inc.* v. *HMG Worldwide Corporation*, RTC's Reply to HMG Worldwide Corporation's Amended Counterclaims, Civil Action No. 00 CV 3300, dated Mar. 7, 2001.

*RTC Industries, Inc.*, v. *Fasteners for Retail, Inc.*, and SuperValu, Inc. d/b/a Cub Foods, Complaint, Civil Action No. 05C 6940.

*RTC Industries, Inc.* v. *HMG Worldwide Corporation*, Notice of Motion, Civil Action No. 00 Civ. 3300 (JHL), dated Feb. 22, 2001.

*RTC Industries, Inc.* v. *William Merit & Associates, Inc.*, Evidentiary Objections to RTC Industries, Inc.'s Memorandum in Opposition to William Merit & Associates' Motion for Partial Summary Judgment, Civil Action No. 04 C 1254, dated Jul. 2, 2004.

*RTC Industries, Inc.*, v. *William Merit & Associates, Inc.*, William Merit & Associates' Reply to RTC Industries, Inc.'s Response to William Merit & Associates' Statement under Local Rule 56.1 of Material Facts to Which There is No Genuine Issue and Statement of Additional Facts that Require the Denial of Summary Judgment, Civil Action No. 04 C 1254, dated Jul. 2, 2004.

*RTC Industries, Inc.* v. *William Merit & Associates, Inc.*, Exhibits and Declarations in Support of William Merit & Associates, Inc.'s Reply to RTC Industries, Inc.'s Memorandum in Opposition to William Merit & Associates' Motion for Partial Summary Judgment, Civil Action No. 04 C 1254, dated Jul. 2, 2004.

*RTC Industries, Inc.*, v. *William Merit & Associates, Inc.*, Notice of RTC Industries, Inc.'s Motion for Leave to File its Sur-Reply to William Merit's Motion for Partial Summary Judgment, Civil Action No. 04 C 1254, dated Jul. 6, 2004.

*RTC Industries, Inc.*, v. *William Merit & Associates, Inc.*, RTC Industries, Inc.'s Sur-Reply to William Merit's Motion for Partial Summary Judgment, Civil Action No. 04 C 1254, dated Jul. 6, 2004.

*RTC Industries, Inc.* v. *William Merit & Associates, Inc.* RTC's Response to Defendant's Evidentiary Objections to RTC Industries, Inc.'s Memorandum in Opposition to William Merit & Associates' Motion for Partial Summary Judgment, Civil Action No. 04 C 1254, dated Jul. 6, 2004.

*RTC Industries, Inc.* v. *Fasteners for Retail Inc.*, Plaintiff RTC Industries Inc.'s Complaint, Civil Action No. 03C 3137, dated May 12, 2003.

*RTC Industries, Inc.*, v. *Fasteners for Retail Inc.*, and CVS Corporation, Amended Complaint, Civil Action No. 03C 3137, dated Aug. 6, 2003.

*RTC Industries, Inc.* v. *Semasys, Inc.*, and Uni-Sun, Inc., Complaint, Civil Action No. 04C 4081, dated Jun. 17, 2004.

*RTC Industries, Inc.* v. *Display Specialties, Inc.*, Complaint, Civil Action No. 04C 3370, dated May 12, 2004.

*RTC Industries, Inc.* v. *William Merit & Associates, Inc.*, Complaint, Civil Action No. 04C 1254, dated Feb. 18, 2004.

*RTC Industries, Inc.* v. *William Merit & Associates, Inc.*, Defendant's Notice of Motion for Partial Summary Judgment of Non-Infringement that Claims 1-8 of U.S. Patent No. 4,830,201 are Not Infringed, Civil Action No. 040 1254, dated Apr. 29, 2004.

*RTC Industries, Inc.*, v. *William Merit & Associates*, William Merit & Associates, Inc.'s Statement Under Local Rule 56.1 of Material Facts to Which There is no Genuine Issue, Civil Action No. 04 C 1254, dated Apr. 29, 2004.

*RTC Industries, Inc.* v. *William Merit & Associates, Inc.*, Defendant's Notice of Motion for Leave to File Memorandum in Support of Motion for Partial Summary Judgment in Excess of p. Limit, Civil Action No. 04 C 1254, dated Apr. 29, 2004.

*RTC Industries, Inc.* v. *William Merit & Associates, Inc.*, Declaration of William Merit in Support of Defendant's Motion for Partial Summary Judgment that Claims 1-8 of U.S. Patent No. 4,830,201 are Not Infringed, Civil Action No. 04 C 1254, dated Apr. 29, 2004.

*RTC Industries, Inc.* v. *William Merit & Associates, Inc.*, RTC Industries, Inc.'s Responses to Defendant William Merit & Associates, Inc.'s First Set of Requests for Admission to Plaintiff Rtc Industries, Inc., Civil Action No. 04 C 1254, dated Jun. 1, 2004.
*RTC Industries, Inc.*, v. *William Merit & Associates, Inc.*, RTC Industries, Inc.'s Memorandum in Opposition to William Merit & Associates' Motion for Partial Summary Judgment, Civil Action No. 04 C 1254, dated Jun. 18, 2004.
*RTC Industries, Inc.* v. *William Merit & Associates, Inc.*, Notice of Filing of Additional Exhibit (The Chesley Patent) to RTC Industries, Inc.'s Memorandum in Opposition to William Merit & Associates' Motion for Partial Summary Judgment, Civil Action No. 04 C 1254, dated Jun. 22, 2004.
*RTC Industries, Inc.* v. *William Merit & Associates, Inc.*, William Merit & Associates Inc.'s Reply to RTC Industries, Inc.'s Memorandum in Opposition to William Merit & Associates' Motion for Partial Summary Judgment, dated Jul. 2, 2004.
*RTC Industries, Inc.*, v. *William Merit & Associates, Inc.*, Memorandum Opinion, Civil Action No. 04 C 1254, dated Jul. 15, 2004.
*RTC Industries, Inc.* v. *Fasteners for Retail Inc.*, and CVS Corporation, Reply, Civil Action No. 03C 3137, dated Sep. 17, 2003.
*RTC Industries, Inc.* v. *Fasteners for Retail, Inc.* and CVS Pharmacy, Inc., to Vulcan Spring & Mfg. Co., Subpoena in a Civil Case, Case No. 03C 3137 N.D. Illinois, dated Oct. 28, 2003.
*RTC Industries, Inc.* v. *Fasteners for Retail Inc.*, and CVS Pharmacy, Inc., to Rexam Beauty and Closures, Inc., Subpoena in a Civil Case, Case No. 03C 3137 N.D. Illinois, dated Nov. 11, 2003.
*RTC Industries, Inc.* v. *Fasteners for Retail Inc.*, and CVS Pharmacy, Inc., to Rexam Cosmetic Packaging, Inc., Subpoena in a Civil Case, Case No. 03C 3137 N.D. Illinois, dated Nov. 11, 2003.
*RTC Industries, Inc.* v. *Fasteners for Retail Inc.*, and CVS Pharmacy, Inc. to Rexam Cosmetic Packaging, Inc., Subpoena in a Civil Case, Case No. 03C 3137 N.D. Illinois, dated Nov. 11, 2003.
*RTC Industries, Inc.* v. *Fasteners for Retail Inc.*, and CVS Corporation, Notice of Motion to Modify and Temporarily Quash Five Subpoenas for Violation of Federal Rule of Civil Procedure 45, Civil Action No. 03C 3137, dated Dec. 8, 2003.
*RTC Industries, Inc.* v. *Fasteners for Retail, Inc.* and CVS Pharmacy, Inc., Defendants' Opposition to Plaintiff's Motion to Modify and Temporarily Quash Five Subpoenas for Violation of Federal Rule of Civil Procedure 45, Case No. 03C 3137, dated Dec. 10, 2003.
*RTC Industries, Inc.* v. *Fasteners for Retail Inc.*, and CVS Corporation, RTC Industries' Reply to Defendants' Opposition to RTC's Motion to Modify and Temporarily Quash Five Subpoenas for Violation of Federal Rule of Civil Procedure 45, Civil Action No. 03C 3137, dated Dec. 11, 2003.
*RTC Ind. Inc.* v. *Fasteners for Retail*, Minute Order of Dec. 12, 2003 by Honorable Joan B. Gottschall, Case No. 1:03-cv-03137.
*RTC Industries, Inc.*, v. *William Merit & Associates, Inc.*, RTC Industries, Inc.'s Response to William Merit & Associates Statement under Local Rule 56.1 of Material Facts to Which There is No Genuine Issue and Statement of Additional Facts that Require the Denial of Summary Judgment, Civil Action No. 04 C 1254, dated Jun. 18, 2004.
*RTC Industries, Inc.*, v. *William Merit & Associates, Inc.*, Index of Exhibits, Civil Action No. 04 C 1254, dated Jun. 18, 2004.
International Search Report mailed Aug. 5, 2010.
*RTC Industries, Inc.*, v. *Henschel-Steinau, Inc.*, Complaint, Case: 1:11-cv-05497 Document #:1 Filed: Aug. 12, 2011 p. 1 of 6 ID#:1.
*RTC Industries, Inc.*, v. *Henschel-Steinau, Inc.*, Plaintiff's Notice of Dismissal Pursuant to Fed. R.. Civ. P. 41(a)(1)(A)(i) Case: 1:11-cv-05497 Document #: 15 Filed: Oct. 21, 2011 p. 1 of 3 p. ID #:51.
*RTC Industries, Inc.*, v. *Henschel-Steinau, Inc.*, Complaint, Case: 1:10-cv-07460 Document #:1 Filed Nov. 19, 2010.

* cited by examiner

FIG. 3
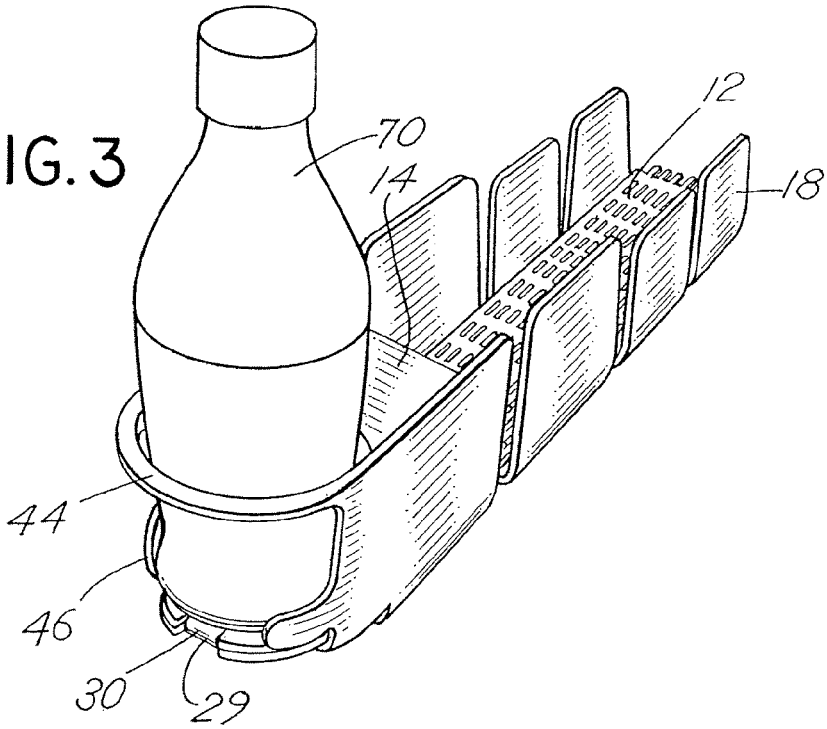
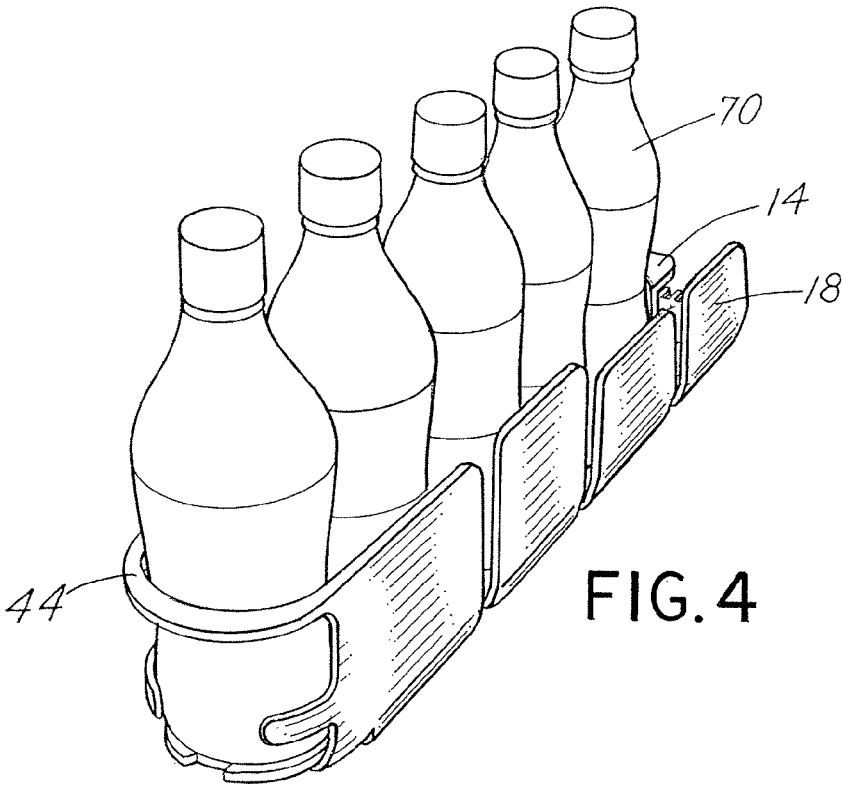
FIG. 4

FIG.9
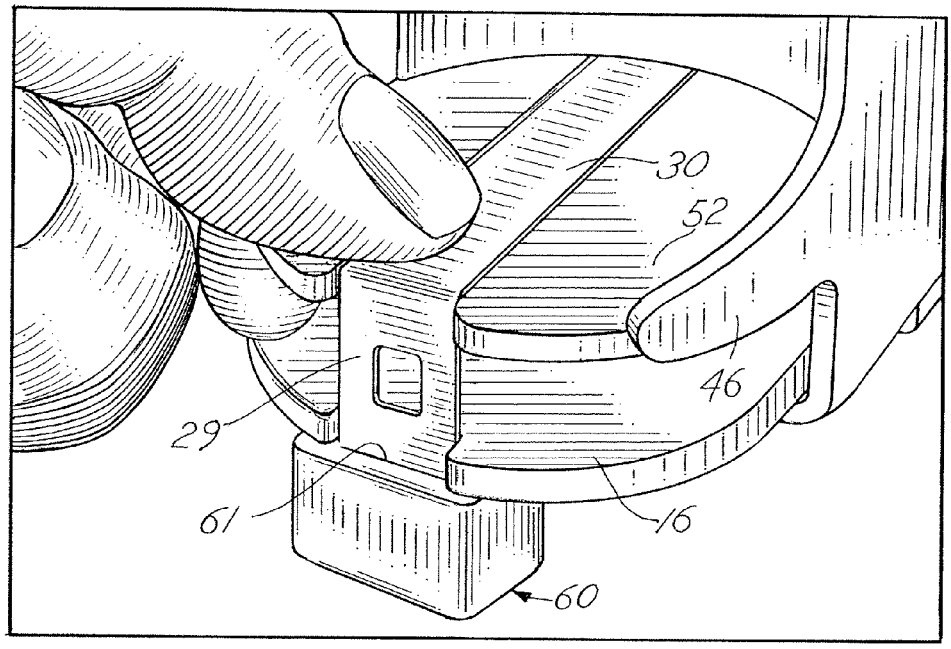
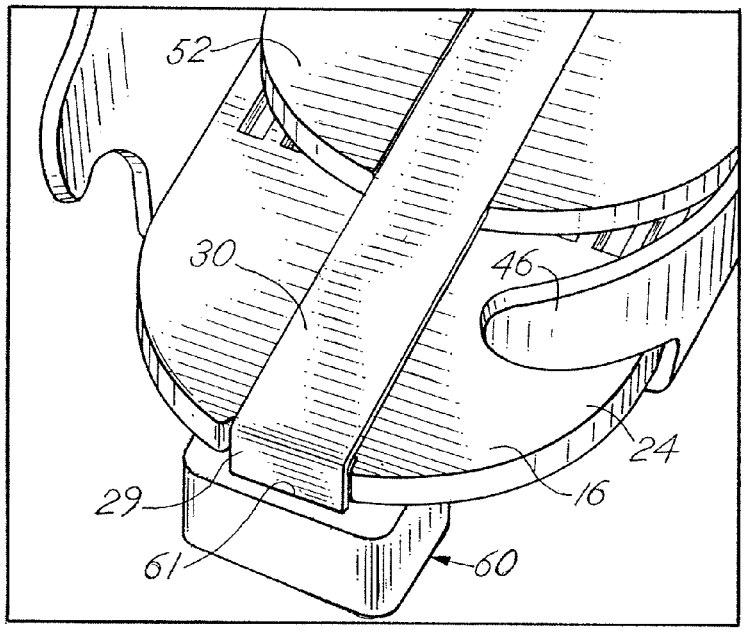
FIG.10

FIG.11
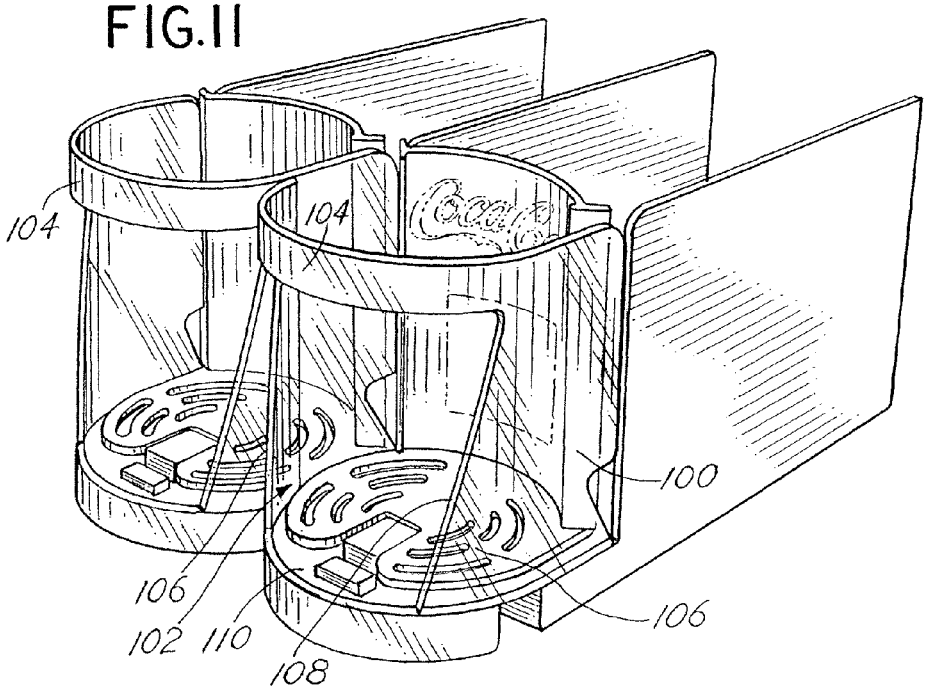
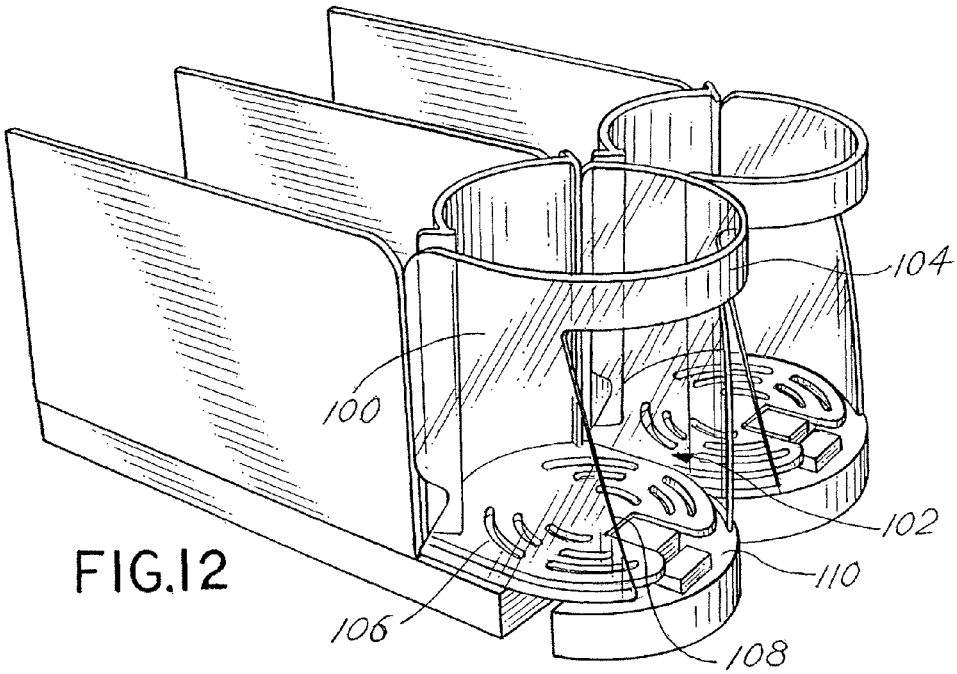
FIG.12

FIG.13
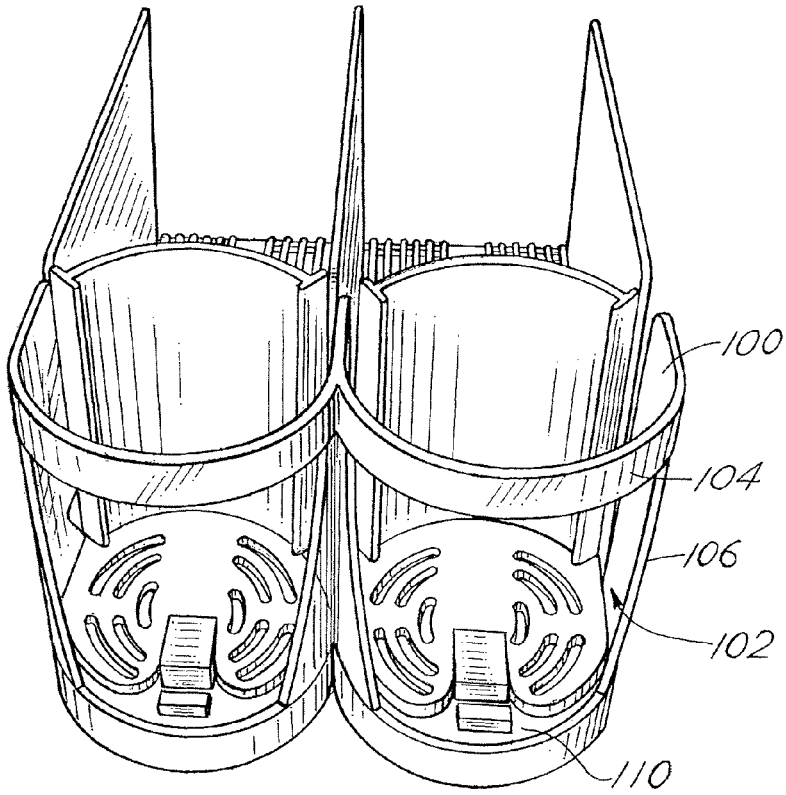
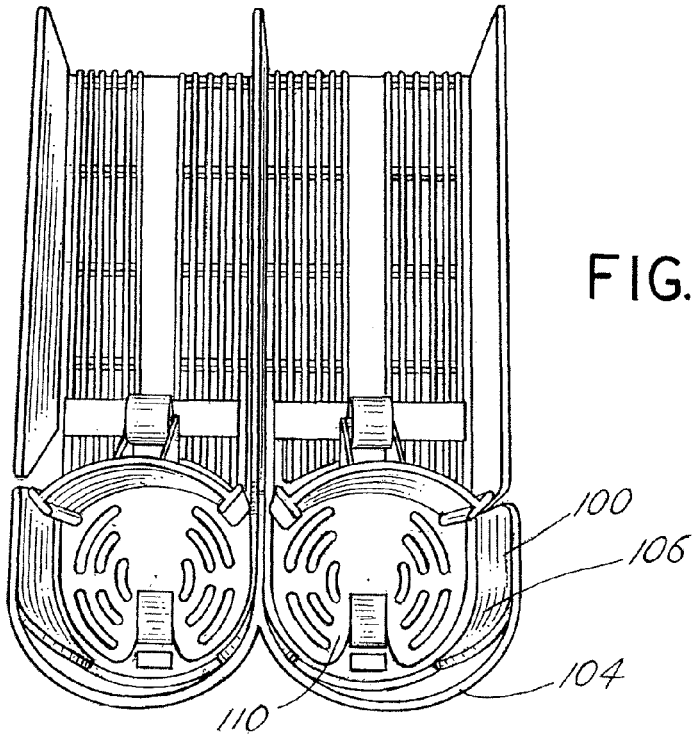
FIG.14

FIG. 21
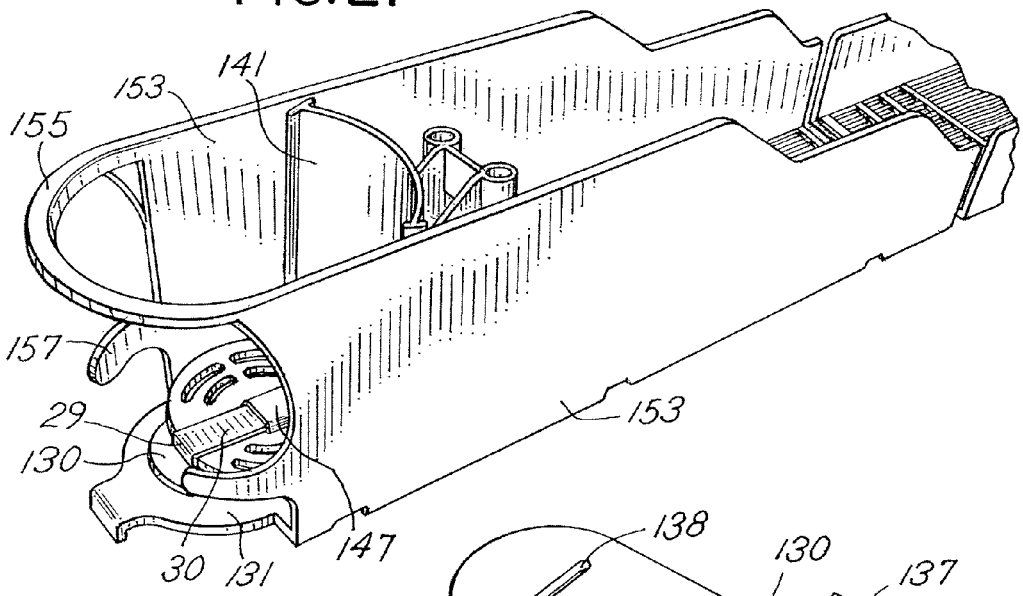
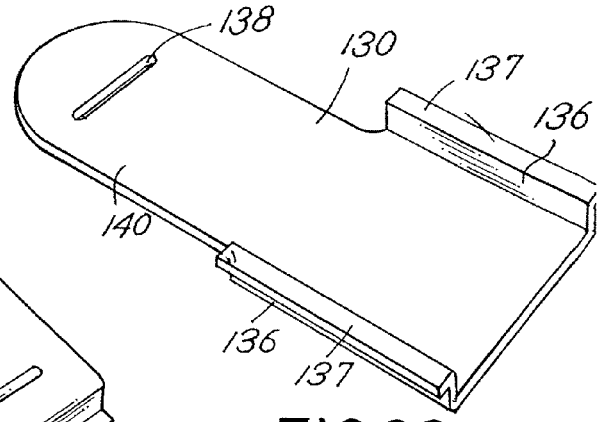
FIG. 22
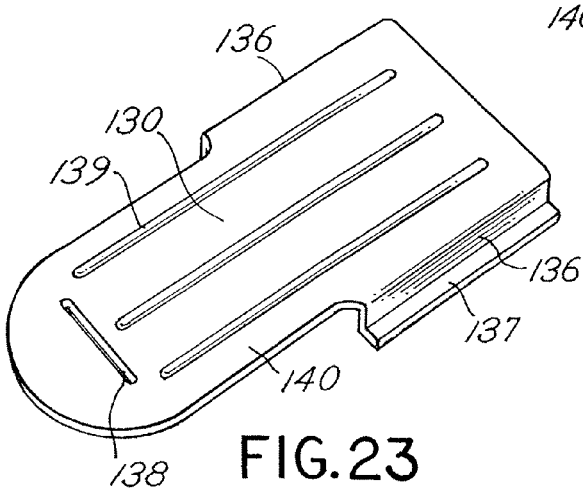
FIG. 23

FIG. 28
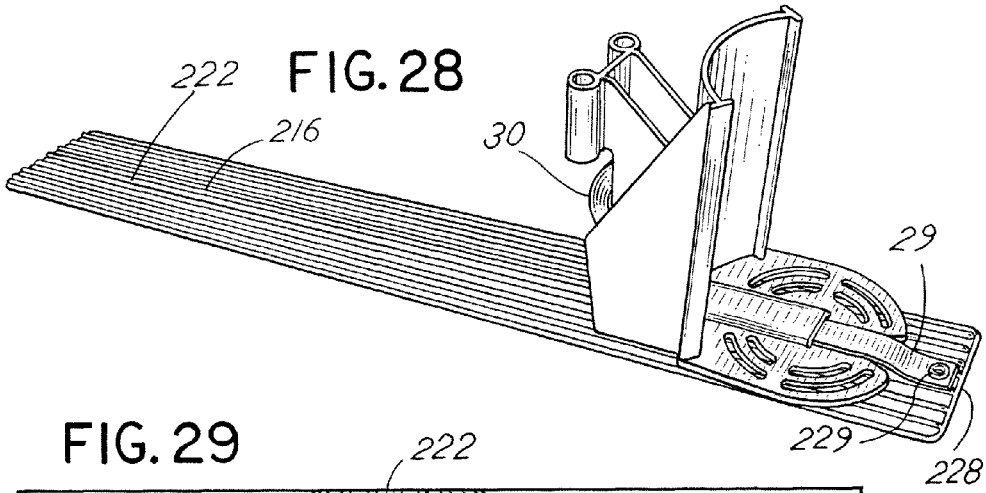
FIG. 29
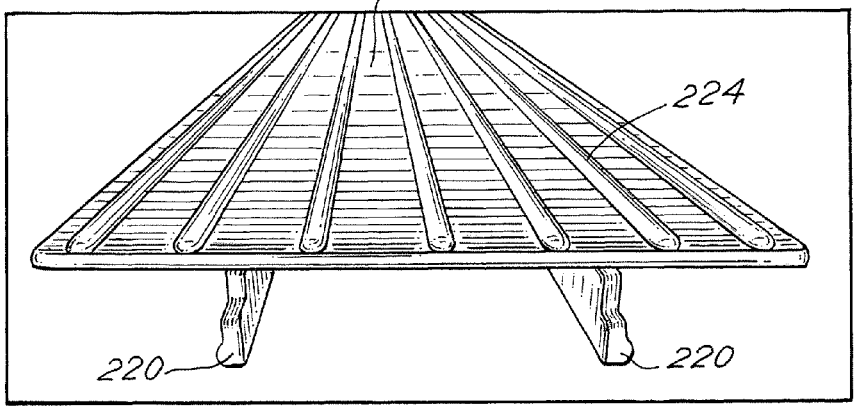
FIG. 29 A
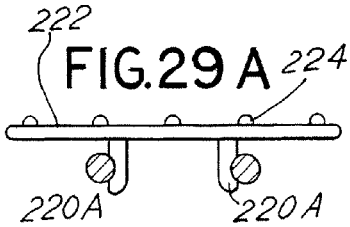
FIG. 29B
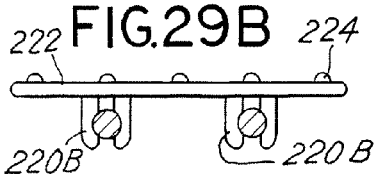
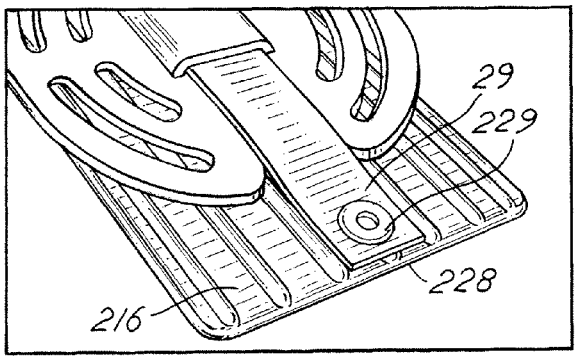
FIG. 30

FIG.31
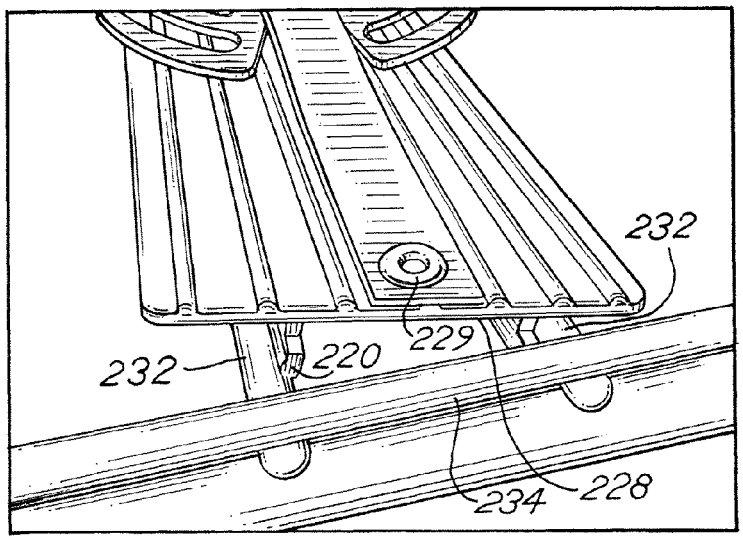
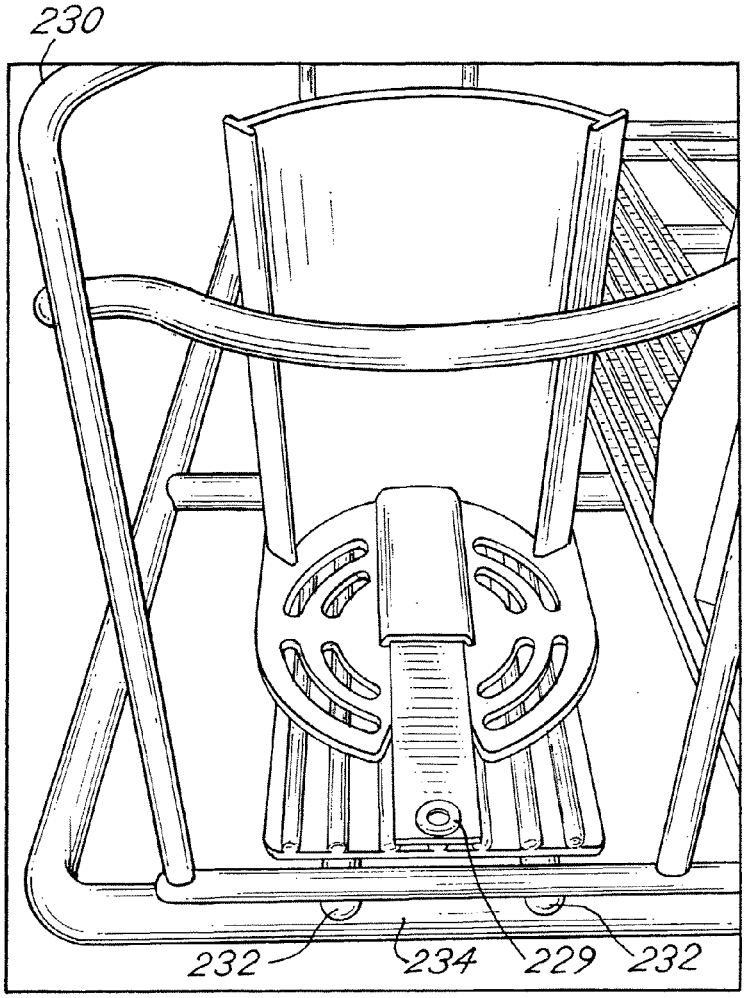
FIG.32

PRODUCT MANAGEMENT DISPLAY SYSTEM WITH TRACKLESS PUSHER MECHANISM

CROSS REFERENCE TO RELATED APPLICATION

This Application is a continuation-in-part application of U.S. application Ser. No. 11/411,761 filed Apr. 25, 2006 which claims benefit to U.S. Provisional Application Ser. Nos. 60/716,362 filed Sep. 12, 2005 and 60/734,692 filed Nov. 8, 2005, all of which are incorporated herein by reference.

FIELD OF THE INVENTION

The present invention relates generally to a shelf assembly for use in merchandising product and more particularly to a shelf assembly having improved mechanisms for displaying and pushing product on the shelves.

BACKGROUND OF THE INVENTION

It is known that retail and wholesale stores, such as convenience stores, drug stores, grocery stores, discount stores, and the like, require a large amount of shelving both to store product and to display the product to consumers. In displaying product, it is desirable for the product on the shelves to be situated toward the front of the shelf so that the product is visible and accessible to consumers. In the case of coolers or refrigerators that are used to store and display such products as soft drinks, energy drinks, bottled water, and other bottled or canned beverages, it is desirable for these products to also be situated toward the front of the shelf and visible and accessible to the consumers.

To accomplish this placement of product, known systems may include inclined trays or floors that through gravity will cause the product to move toward the front of the shelf. Many of these systems include floors or shelves made of a plastic material such as polypropylene that due its low coefficient of friction permit the product to easily slide along the inclined floor or surface. However, over time, these surfaces can become obstructed with debris or sticky substances that inhibit the product from properly sliding, sometimes causing several products to tip over thus blocking additional product from moving to the front of the shelf.

Other systems include the use of a pusher system to push the product toward the front of the shelf as the product at the front of the shelf is removed. The known pusher systems are typically mounted to a track and include a pusher paddle and a coiled spring to urge the product forward. Occasionally, as the system is used, and over time, the track becomes obstructed with dirt or sticky materials that hinder the proper operation of the pusher system in the track. In addition, depending on the size, shape and weight of the product to be merchandised, the known pusher paddles may occasionally tip or bend backwards, thereby causing a binding of the pusher mechanism in the track. In those situations, the pusher mechanism may not properly push product toward the front of the shelf.

The present invention is directed at improving upon existing merchandising systems by providing a trackless pusher system that works with gravity-fed merchandise systems (i.e., inclined shelves or trays) and non-gravity-fed merchandise systems.

SUMMARY OF THE INVENTION

The present invention is directed to a product management display system for merchandising product on a shelf. The invention includes using a trackless pusher mechanism that travels along a surface on which product is placed. The trackless system overcomes the known problems with the use of tracks to hold and guide the known pusher mechanisms. It should be understood however that the teachings of the invention may be used with systems that include tracks for mounting a pusher mechanism or the like.

The pusher mechanism of the invention also includes a pusher paddle and a floor that extends forward of the pusher paddle. A flat coiled spring or other biasing element is operatively connected behind the pusher paddle and extends across the floor of the pusher mechanism and to the front of the shelf. In use, the product to be merchandised is placed on the coiled spring and on the floor of the pusher mechanism. With this configuration, the pusher paddle is prevented from tipping or bending backwards during operation.

The invention also includes use of a pushing mechanism with the merchandising of product on horizontal or non-inclined shelves or surfaces, as well as with gravity-fed systems, or systems that use gravity as a mechanism to urge product toward the front of the shelf.

In accordance with an illustrative embodiment of the invention, the pusher paddle may define a concave pushing surface for pushing cylindrical products, such as soft drink bottles or cans. Alternatively, the pusher paddle may define a flat pushing surface that may further include at its upper edge a curved rib or similar structure that can be used to push cylindrical products.

In accordance with another illustrative embodiment of the invention, the floor of the pusher mechanism includes a notched or cut-out portion to align the pusher mechanism relative to the coiled spring. Also, the floor of the system also includes a notch or cut-out portion for receiving and mounting a flat end of the coiled spring to the floor. A spring tip may be placed on the end of the coiled spring to mount the coiled spring to the floor of the system.

In accordance with yet another aspect of the invention, an adaptor for a product management display system may be positioned on a floor surface of the display system. The adaptor may include a planar surface with at least two ribs extending outwardly from the planar surface and across the planar surface in a substantially parallel manner. A coiled spring may be positioned between the parallel extending ribs. With this configuration, product to be merchandised may sit on the ribs, and not directly on the coiled spring, to enhance the forward movement of certain types of product, such as cans of a beverage.

In yet another alternative aspect of the invention, a mounting member may be used to mount the end of the coiled spring to the floor of the system. For those systems that include spaced-apart glide rails that are joined together by connecting ribs, the mounting member may be snap-fit to or otherwise mounted on the floor and between the glide rails.

In yet another alternative aspect of the invention, the trackless pusher system is retrofitted into an existing shelf assembly. This allows for the placement of the trackless pusher system in an existing shelving system as a low cost alternative to purchasing the entire trackless pusher assembly.

BRIEF DESCRIPTION OF THE DRAWINGS

FIG. 3 depicts another isometric view of the system of FIG. 2 with product placed in the system.

FIG. 4 depicts another isometric view of the system of FIG. 2 with multiple product placed in the system.

FIG. 9 depicts the exemplary tip of FIG. 7 being mounted to an end of a coiled spring.

FIG. 10 depicts the exemplary tip of FIG. 7 mounted to an end of a coiled spring.

FIG. 11 depicts an isometric view of an alternative exemplary embodiment of a product management display system of the present invention.

FIG. 12 depicts another isometric view of the system of FIG. 11.

FIG. 13 depicts a front view of the system of FIG. 11.

FIG. 14 depicts a top view of the system of FIG. 11.

FIG. 21 depicts an isometric view of an alternative exemplary embodiment of a product management display system of the present invention.

FIG. 22 depicts an isometric bottom view of an exemplary mounting member that may be used to mount the end of the coiled spring to the floor of the display system.

FIG. 23 depicts an isometric top view of the exemplary mounting member of FIG. 22.

FIG. 28 depicts an isometric view of an alternative exemplary embodiment of a product management display system of the present invention.

FIG. 29 depicts a close-up isometric view of the tray of the exemplary embodiment of FIG. 28.

FIG. 29 A depicts a cross-sectional view of the exemplary embodiment of FIG. 28 illustrating a first securing method.

FIG. 29 B depicts a cross-sectional view of the exemplary embodiment of FIG. 28 illustrating a second securing method.

FIG. 30 depicts a close-up isometric view of the embodiment of FIG. 28 illustrating the rivet attaching the spring to the tray.

FIG. 31 depicts an isometric view of the embodiment of FIG. 28 being assembled in a preexisting wire shelf.

FIG. 32 depicts an isometric view of the embodiment of FIG. 28 assembled in a preexisting wire shelf.

Figure 1:
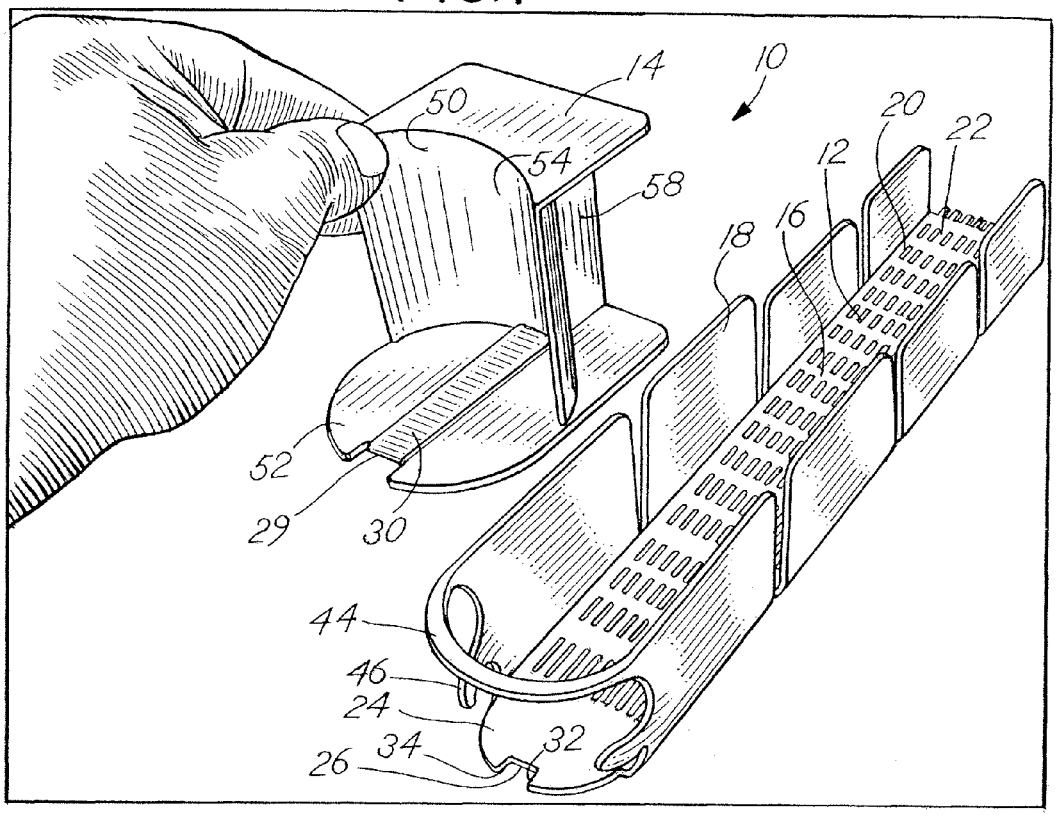
FIG. 1 depicts an isometric exploded view of an exemplary embodiment of a product management display system of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, the use of the term "mount," "mounted" or "mounting" is meant to broadly include any technique or method of mounting, attaching, joining or coupling one part to another, whether directly or indirectly.

DETAILED DESCRIPTION OF THE EMBODIMENTS

The invention may be embodied in various forms. Referring to the Figures wherein like numerals indicate like elements, there is depicted in FIG. 1 an isometric exploded view of an exemplary embodiment of the present invention. Exemplary merchandise system 10 includes a product dispensing tray 12 in which is mounted an exemplary trackless pusher mechanism 14. As described in more detail below, the pusher mechanism 14 will fit in the tray 12 and will slide along the surface of the tray without the use of tracks, rails, or guides typically used to hold a conventional pusher mechanism to the tray or floor of the tray. The pusher mechanism defines a pusher paddle and a pusher floor that extends forward of the pusher paddle. A coiled spring may extend across the pusher floor and operatively connect to the tray at a forward position on the tray. In one aspect of the invention, product to be merchandised may be placed in the tray in front of the pusher paddle and may sit on the pusher floor as well as the coiled spring. With this configuration, the weight of the product will prevent the pusher paddle from tipping to ensure proper pushing of the product. In addition, the problems associated with debris or sticky materials hindering the effectiveness of known pusher systems that use tracks, rails or guides have been eliminated. Other aspects, embodiments and features of the invention and its teachings are set forth in more detail below.

The exemplary tray 12 may define a surface 16 and one or more dividing panels or dividers 18 to separate the tray into numerous rows for placement of product. In an alternative aspect, the tray 12 may be a shelf or any other surface on which products may be placed for merchandising. The surface 16 may be a solid surface or a surface defining a plurality of spaced-apart apertures 20 separated by a plurality of support ribs 22. The apertures 20 and ribs 22 provide a surface that permits the slidable movement of product placed on this surface and also permits liquids and dirt to pass through the apertures 20 so that they do not collect on the surface 16. The surface 16 may be made of any suitable material that permits the slidable movement of product on the surface 16. Other surface or floor configurations are known and may be used with the principles of the invention.

The surface 16 may define a rounded end portion 24 that includes a notch or cut-out portion 26. The end portion 24 may be rounded to match the shape of the product that is placed on the tray. For example, the depicted end portion 24 is rounded or defines a semi-circular shape to match the contour of a bottle or can that may be placed in the tray and on the end portion 24. Other shapes of the end portion may be used with the invention depending on the product to be merchandised.

The notch 26 may be used to receive and mount an end 29 of a coiled spring 30 or similar biasing element. The notch 26 may define opposing angled edge surfaces 32 that are joined by edge 34. The edge 34 is preferably centered across the width of the product row formed in the tray 12 and extends perpendicular to the length of the tray. This configuration will center the coiled spring 30 relative to the tray 12 and will permit the spring to extend in a substantially parallel manner relative to the length of the tray. In other words, the depicted edge 34 of the notch 26 will permit the spring 30 to extend along the length of the tray 12 at or near the center of the product row formed by the tray. One skilled in the art will appreciate that the location and configuration of the notch may vary depending on the desired placement of the spring.

The coiled spring 30 may define an end 29 that is configured to be placed across the notch 26 and onto the edge 34. In one aspect, the end 29 of the coiled spring may be V-shaped and function as a hook such that the end 29 will wrap around the edge 34 with a portion of the end 29 of the coiled spring extending beneath the end portion 24 of the surface 16. This configuration permits an easy installation of the coiled spring onto the tray.

Figure 7:
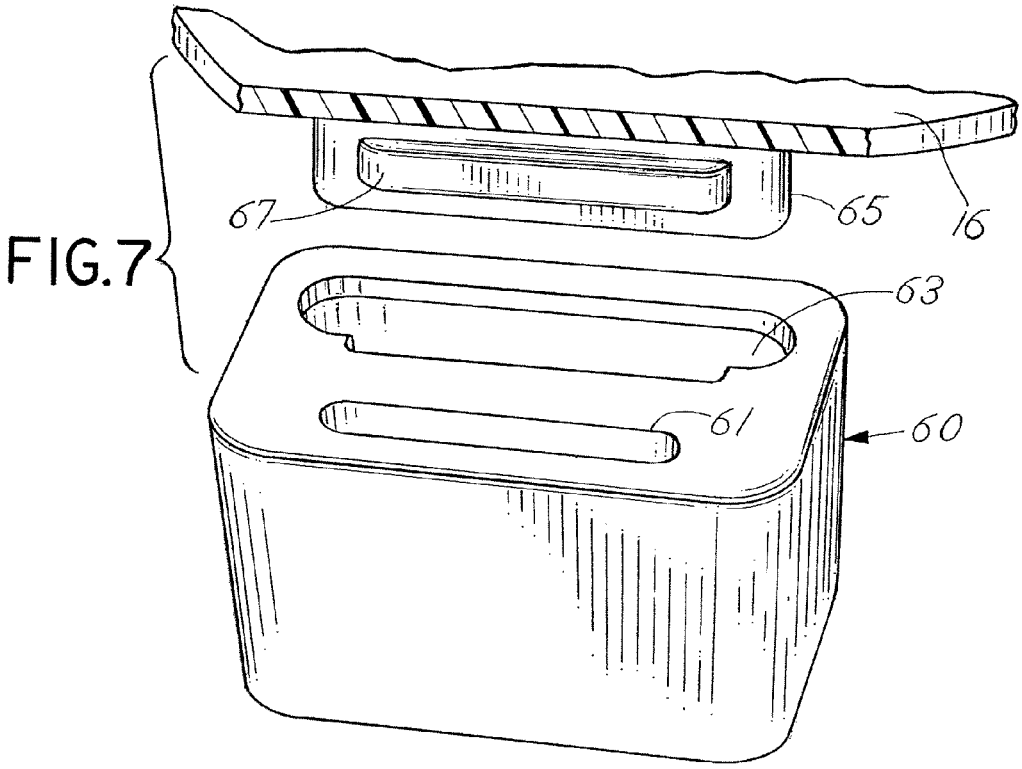
FIG. 7 depicts an exemplary tip for an end of a coiled spring that may be used with the product management display system of the invention.

In another aspect, and referring to FIG. 7, a spring tip 60 may be added to the end 29 of the spring 30 to assist with the mounting of the spring to the system. The spring tip 60 may define numerous shapes and configurations depending on the configuration of the tray and the surface on which the spring end needs to attach. The spring tip 60 may be permanently attached to the end 29 of the coiled spring 30 or it may be detachable to permit the interchange or replacement of the spring tip 60. The spring tip 60 may be made of plastic and may define one or more apertures. Aperture 61 may be used to receive the end 29 of the coiled spring 30. A second aperture 63 may be used to receive a mating tongue or mounting member 65 extending from the surface 16 of the tray 12, as discussed below. With this configuration, the end 29 of the coiled spring 30 may be operatively connected to the tray 12.

In another aspect, the end 29 of the coiled spring may snap-fit into an aperture formed in the surface 16, or may be otherwise inserted and secured to an aperture or opening in the tray, thereby securing the end 29 of the coiled spring 30 in position.

Referring back to FIG. 1, dividers 18 may also be used to separate product into rows. The dividers 18 extend substantially upwardly from the surface 16 and as illustrated in FIG. 1, may be positioned on opposing sides of the surface 16. Alternatively, the dividers 18 may be positioned at any desired position on the tray 12 or to the surface 16. The dividers 18 may be formed as a unitary structure with the surface 16, or the dividers 18 may be detachable to provide added flexibility with the system. The dividers may be attached to a front or back rail depending on the system. The dividers 18 may define numerous configurations and may extend upwardly any desired distance to provide the desired height of the dividers between the rows of product to be merchandised. This height may be adjustable by adding divider extenders or the like.

Figure 6:
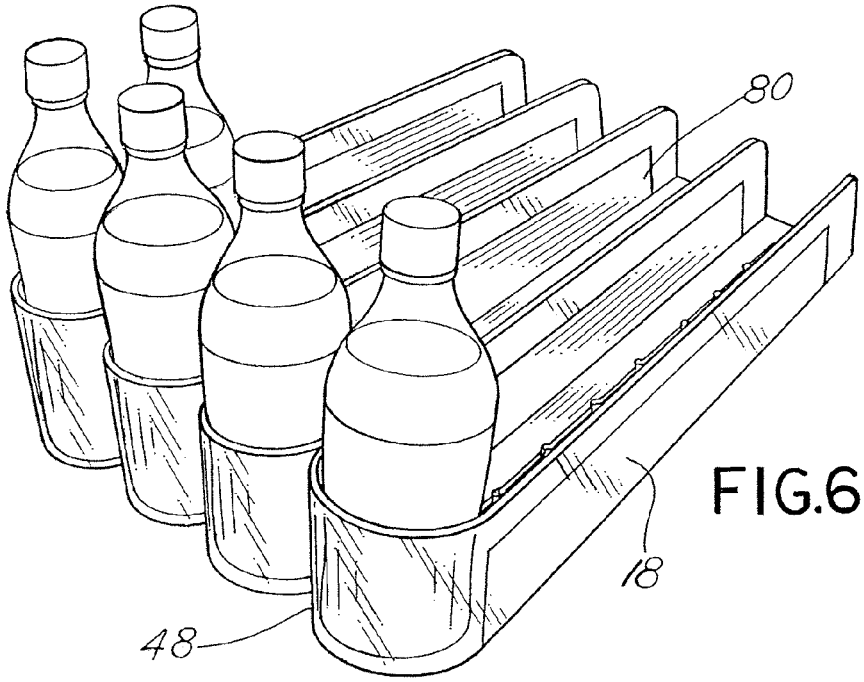
FIG. 6 depicts an alternative embodiment of the tray or product channel of the present invention.

Located at the front of the tray 12 and extending between the dividers 18 may be one or more product-retaining members 44. The product-retaining members 44 serve as a front retaining wall or bar to hold the product in the tray 12 and to prevent the product from falling out of the tray 12. These members are also configured to permit the easy removal of the forward-most product positioned in the tray 12. The product-retaining member 44 may be one or more curve-shaped retaining ribs as depicted in FIG. 1. These illustrated retaining ribs may extend from one divider to another divider thereby joining the dividers. The retaining ribs may also extend part-way between the dividers, as also shown in FIG. 1 as rib 46, to also assist in retaining the product in the tray. Alternatively, and as shown in FIG. 6 the product-retaining member 44 may be a curve-shaped solid retaining wall 48 that extends between dividers. The retaining wall 48 may be transparent or semi-transparent to permit visualization of the product on the shelf. In another aspect, the retaining wall 48 may also extend part-way between the dividers 18. In yet another embodiment depicted in FIGS. 11-15, the retaining wall 100 may be attached to the surface of the tray and not connect to the dividers. In this embodiment, the retaining wall 100 may form an opening 102 defined by an upper member 104, opposing, curved side walls 106 that further define an angled edge 108, and a floor member 110. The side walls 106 may also be straight and not curved depending on the system. The end of the coiled spring may also snap-fit into the floor 110 or otherwise attached to the tray using any of the techniques described herein. One of skill in the art will readily appreciate that there are numerous shapes and configurations possible for the product-retaining member 44 and that the depicted configurations are merely exemplary embodiments of these numerous configurations.

Referring back to FIG. 1, the exemplary trackless pusher mechanism 14 defines a pusher paddle 50 and a pusher floor 52. The pusher paddle 50 and pusher floor 52 may be formed as a single, unitary structure or may be separate structures that are joined together using known techniques. In addition, the pusher paddle 50 and pusher floor 52 may be made of any known suitable plastic or metal material. The pusher paddle and pusher floor may be reinforced using any known reinforcing techniques.

Figure 5:
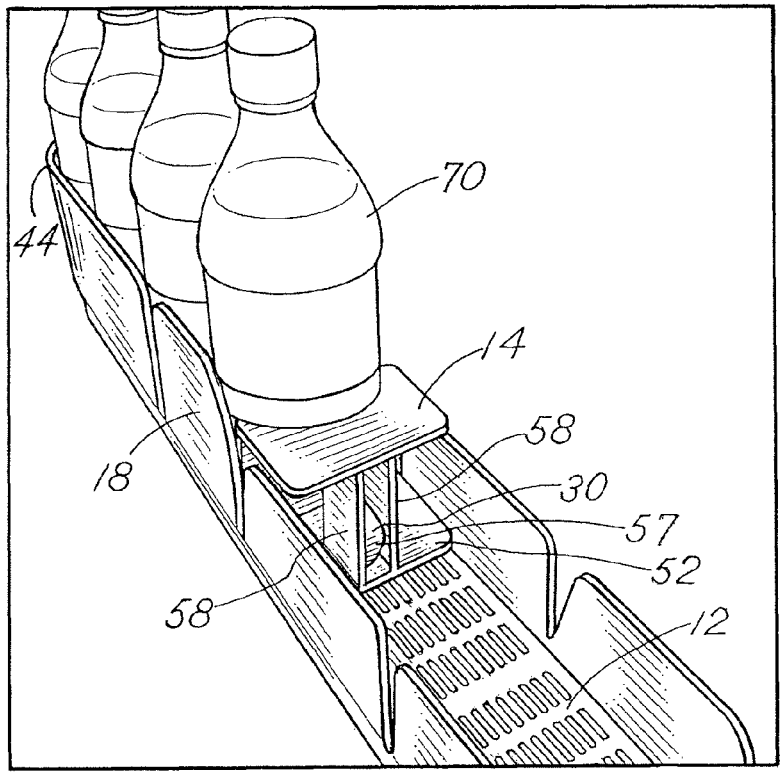
FIG. 5 depicts an isometric rear view of the system of FIG. 4.

In one aspect, the pusher paddle 50 forms a curved-shape pusher surface or face 54 that is configured to match the shape of the product to be merchandised, such as plastic bottles or cans containing a beverage, as depicted in FIGS. 3-5. The curve-shaped pusher surface 54 permits the pusher to remain centrally aligned with the last product in the tray. This configuration reduces friction and drag between the pusher and the divider walls. In an alternative aspect, the pusher surface or face may be a flat surface. In yet another aspect, the flat pusher surface may be accompanied by a curved shaped rib that is positioned near or on the top of the pusher paddle and that may be used to center and align product in the tray, in a manner similar to the curve-shaped pusher surface 54 depicted in FIG. 1. The curve shaped rib may define other shapes and configurations that permit cylindrical or similar shaped products to be properly pushed in the tray. Advertisement, product identification or other product information may be placed on the pusher surface 54.

Positioned behind the pusher surface or face 54 may be one or more support members 58, such as ribs, walls, or gussets. The support members 58 are configured to support the pusher surface 54 and further connect the pusher paddle 50 to the pusher floor 52. As can be seen in FIG. 5, positioned between the support members 58 is the coiled spring 30, and more specifically the coiled end 57 that is used to urge the pusher paddle 50 forward and along the tray 12, as understood in the art. Any technique used to operatively connect the coiled spring to the pusher paddle 50 may be used with the invention.

As shown in FIG. 1, the pusher floor 52 may be positioned below the pusher paddle 50 and may extend forward of the pusher surface 54 of the pusher paddle. The pusher floor 52 may extend any predetermined distance and at any predetermined angle. For example, the pusher floor 52 may extend substantially perpendicular to the pusher surface 54. In the exemplary embodiment, the pusher floor 52 may extend a sufficient distance to permit one product, such as a single bottle or can, to be placed on the pusher floor. In another aspect, the pusher floor 52 may be configured to permit more than one product to be placed on the pusher floor. The pusher floor 52 may define any shape, including the depicted round shape and may define any product retaining features on the surface of the pusher floor, such as ribs, walls, or the like, to further hold the product on the pusher floor.

Figure 2:
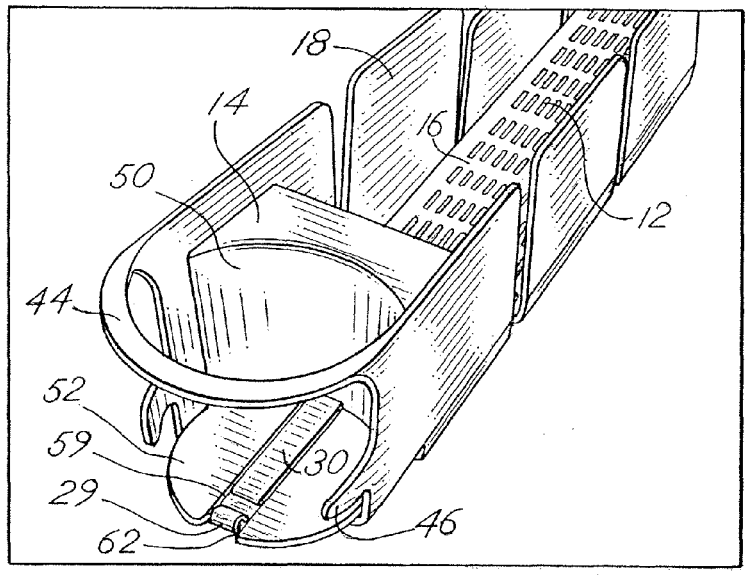
FIG. 2 depicts an isometric view of an exemplary pusher mechanism mounted to an exemplary tray or product channel of the present invention.
Figure 19:
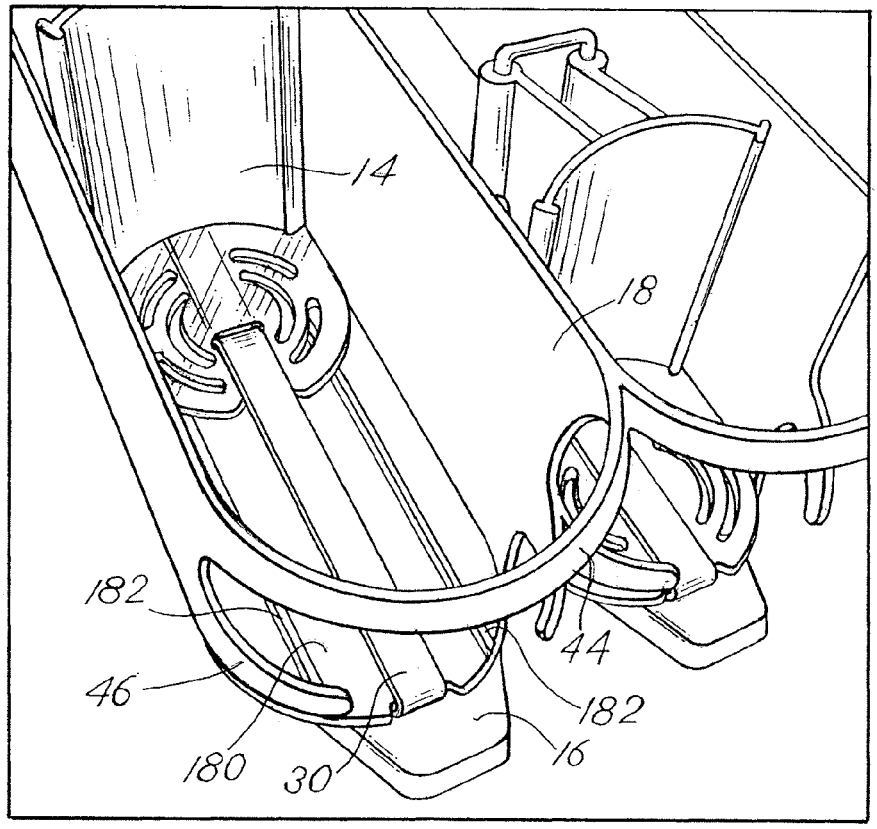
FIG. 19 depicts an isometric view of an installed adaptor of the invention.
Figure 20:
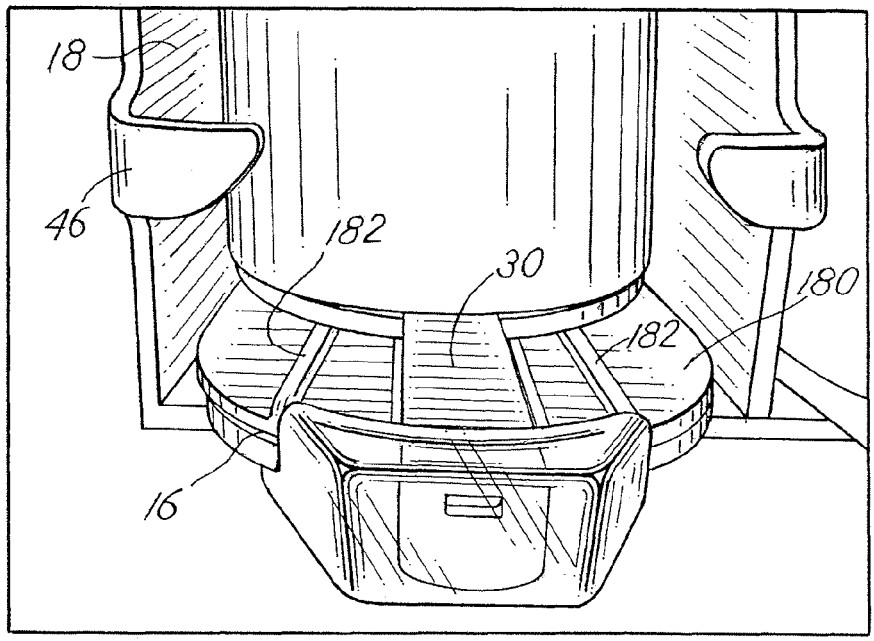
FIG. 20 depicts a front view of an installed adaptor of the invention.

As can be seen in FIG. 2, the pusher floor 52 may define an elongated channel, groove or recessed portion 59 that is sized, shaped and configured to seat the coiled spring 30. In the exemplary embodiment, the channel or groove 59 may extend across the floor 52 and in a substantially perpendicular manner relative to the pusher paddle 50. In an alternative aspect, the groove or channel may extend part-way or across the entire pusher floor 52, as shown in FIG. 19. Such configuration permits the proper alignment and positioning of the pusher paddle 50 in the tray. The groove 59 may define a depth that matches or exceeds the thickness of the coiled spring 30. With this configuration, the coiled spring 30 will seat at or below the pusher floor surface such that product will not sit directly on the coiled spring, rather, such product will sit on the pusher floor surface. As shown in FIG. 19, the pusher floor may include apertures and openings through which debris or other items may pass. Alternatively, the floor may be a solid surface.

Figure 16:
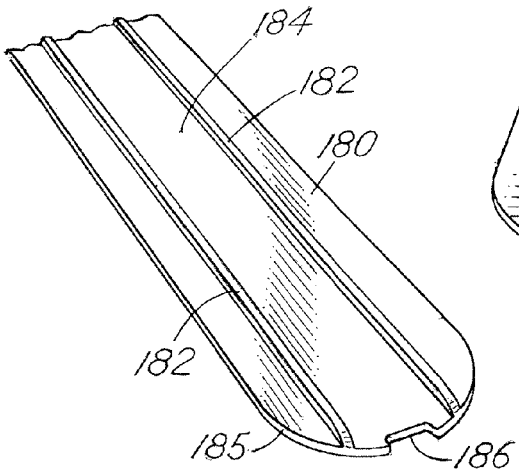
FIG. 16 depicts an isometric view of an adaptor that may be used with the invention.
Figure 17:
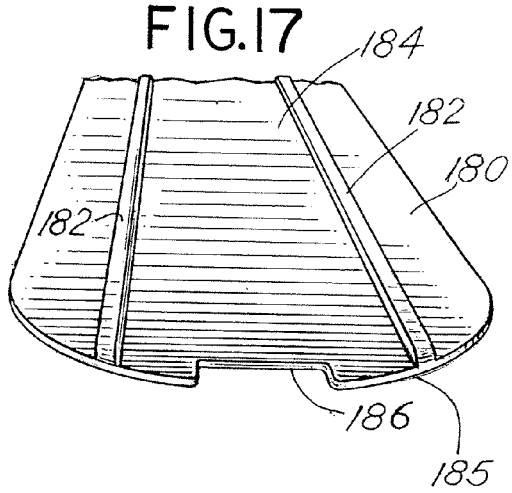
FIG. 17 depicts a front view of the adaptor of FIG. 16.

In an alternative aspect of the invention, as shown in FIGS. 16-20, an adaptor 180 may be positioned on the surface 16. Referring to FIGS. 16 and 17, the adaptor 180 may include one or more raised ribs 182 on which a product may sit. The raised ribs 182 may extend longitudinally along the length of the adaptor 180. The adaptor 180 may be a flat extrusion of plastic material (or any other suitable material) defining a planar surface 184 with the one or more ribs 182 extending outwardly from the planar surface 184. The adaptor 180 may define a rounded end 185 and include a notch or cut-away portion 186 through which or across which the coiled spring may extend. The rounded end 185 may be configured to match the shape of the product that is placed on the tray. Other shapes of the end 185, notch 186 and adaptor 180 may be used with the invention depending on the product to be merchandised. The adaptor 180 may be a separate, insertable piece or, alternatively, a piece formed integral with the surface 16.

Figure 18:
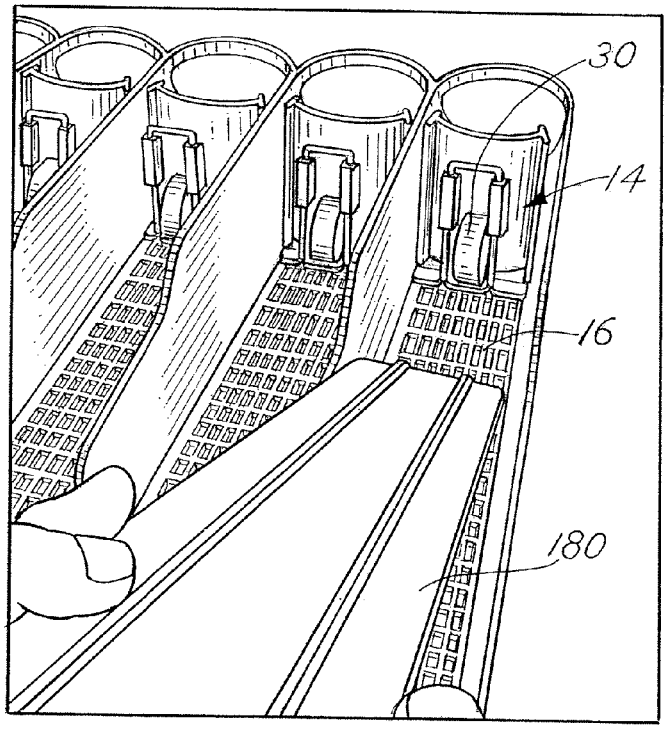
FIG. 18 depicts an exemplary installation of the adaptor of the invention.

Referring to FIG. 18, the adaptor 180 may be easily insertable onto the surface 16 and between the dividers 18. Referring to FIG. 19, once the adaptor 180 is installed, the pusher mechanism 14 may be positioned on top of the adaptor 180 and may slide freely across the ribs 182 of the adaptor 180. The coiled spring 30 may extend in a parallel manner between the ribs 182 and may seat at or below the top surface of the ribs 182, as more clearly shown in FIG. 20. With this configuration, the product to be merchandised may sit on, and slide along, the ribs 182 and not on the coiled spring 30.

In an alternative aspect, the ribs 182 may be a raised bead or raised beads, or a series of fingers that may be used to facilitate the movement of the product on the surface 16. In yet another alternative embodiment, the ribs 182 may be product moving members, such as runners or one or more rollers or rolling members that permit the product to roll across the rolling members and toward the front of the product display system. Exemplary roller assemblies include those disclosed and described in U.S. application Ser. No. 11/257,718 filed Oct. 25, 2005 and assigned to RTC Industries, Inc, which application is incorporated herein by reference. As should be appreciated by those skilled in the art, there are many possible techniques that may be used with the described pusher mechanisms for facilitating the movement of the product on the shelf or floor.

The underneath side of the pusher floor 52 may be a smooth planar surface that will slide freely along the surface 16. Alternatively, and similar to above, the pusher floor 52 may include beads, runners, rollers or the like that will permit the pusher floor to slide along the surface yet raise the pusher floor up off of the surface 16. In another alternative embodiment, the underneath side of the pusher floor may be configured with rail mounting members to permit the mounting of the pusher to a track or rail, as understood in the art.

The pusher floor further defines a notch or cut-out portion 62 through which will pass the coiled spring 30. The end 29 of the coiled spring 30 will pass through the notch 62 and through the notch 26 of the surface 16 and will mount to the tray using any of the techniques described above.

In use, as the pusher mechanism 14 is urged rearward in the tray 12, the end 29 of the coiled spring 30 will be held in position as described above and the coiled end 57 of the spring 30 will begin to uncoil behind the pusher paddle 50. If the pusher 14 is allowed to move forward in the tray 14, such as when product is removed from the front of the tray, the coiled end 57 of the spring 30 will coil and force the pusher paddle 50 forward in the tray 12, thereby urging product toward the front of the tray.

In an alternative embodiment, the coiled spring 30 may extend below and underneath the pusher floor 52 as opposed to above and across the pusher floor, as depicted in the figures. With this configuration, the groove 59 and notch 62 may not be necessary.

The coiled spring 30 may be any biasing element including, without limitation, a flat coil spring commonly used with pusher systems. The present invention may use one or more coiled springs to urge the pusher mechanism 14 forward depending on the desired application. The coil tension of the spring 30 may also vary depending on the particular application.

Referring to FIG. 2, the trackless pusher mechanism 14 is shown mounted to the tray 12. As illustrated, the pusher mechanism 14 fits in the tray 12 between the dividers 18. End 29 of the coiled spring 30 extends through the notch in the pusher floor and mounts to the tray as described above. In use, the pusher mechanism 14 will slide along the surface 16 of the tray 12 without the use of tracks, rails, or guides. As depicted in FIG. 2, the pusher mechanism 14 is shown in a forward position.

Referring to FIG. 3, the pusher mechanism 14 is shown merchandising one product 70 in the merchandise system 10. The product is prevented from tipping out of the tray by the product-retaining member 44. The product 70 may be any product to be merchandised including the depicted soft drink bottle. As shown in this Figure, the product 70 sits on the pusher floor 52 and the coiled spring 30 that extends below the product. The weight of the product on the floor 52 and the positioning of the product across the spring 30 prevent the paddle 50 from tipping in the tray 12.

Referring to FIG. 4, the pusher mechanism 14 is shown merchandising multiple products 70 in the merchandise system 10. As shown in this Figure, the product next to the pusher paddle 50 sits on the pusher floor 52 and the coiled spring 30 that extends below the product. The other products will sit on the coiled spring 30 that will extend below these products. Alternatively, the adaptor 180 may be positioned in the system in which case the product may sit on the ribs 182 of the adaptor as opposed to the coiled spring. Again, the weight of the product on the pusher floor 52 and the positioning of the products across the spring 30 prevent the paddle 50 from tipping in the tray. In use, as one product is removed from the front of the tray near the product-retaining member 44, the pusher mechanism 14 (through the urging of the coiled spring 30) will push the remaining product forward in the tray 12 until the forward-most product contacts the product-retaining member 44. As additional products are removed, the pusher mechanism 14 will continue to push the remaining product toward the product-retaining member 44.

Referring to FIG. 5, a rear view of the pusher mechanism 14 shows the pusher mechanism 14 merchandising multiple products 70 in the merchandise system 10. Again, the product next to the pusher paddle 50 sits on the pusher floor 52 and the coiled spring 30 that extends below the product. The other products will sit on the coiled spring that will extend below these products. Alternatively, the adaptor 180 may be positioned in the system in which case the product may sit on the ribs 182 of the adaptor as opposed to the coiled spring. As one product is removed from the front of the tray near the product-retaining member 44, the coiled end 57 of the spring 30 will urge the pusher paddle 50 of the pusher mechanism 14 forward in the tray 12 until the forward-most product contacts the product-retaining member 44. As can be seen in this Figure, the coiled end 57 may be positioned between two support members 58. The support members will retain the coiled spring between these members. As can be seen in this Figure, the pusher floor 52 may also extend below the support members 58.

Referring to FIG. 6, an alternative embodiment of the pusher tray is depicted. With this embodiment, multiple trays 12 may be formed into a single multi-tray assembly 80. The multi-trays may have a common floor with dividers 18 extending upwardly from the floor to create the multiple trays or rows. In this embodiment, the product-retaining member 44 may be a solid member that extends between two dividers, as discussed above. One or more of the multi-tray assemblies 80 may be coupled or joined together in a side-by-side manner using any known technique, including clips, dovetailing, fasteners, or the like. With this configuration, numerous rows of product can be provided for the merchandising of numerous products.

As stated above, the trackless pusher mechanism 14 may be used with gravity-fed systems, that is, systems having trays or product channels that are mounted on an incline to permit gravity to assist with the merchandising of the product. Alternatively, the trackless pusher mechanism 14 may be used with systems that are mounted in a non-inclined or in a horizontal manner where gravity will provide little or no assistance with the merchandising of the product. The trackless pusher mechanism 14 may also be used to push various shaped products.

FIG. 7 depicts an exemplary tip 60 for the end 29 of a coiled spring 30 that may be used with the merchandise system 10. As illustrated, the tip 60 defines an aperture 61 for receiving the end 29 of the coiled spring and an aperture 63 for mounting to the surface 16 of the tray. As can be seen in FIG. 7, in one aspect of an alternative embodiment, extending beneath the surface 16 may be a tongue or mounting member 65 that may be configured to mate with the aperture 63 and to snap-fit the tip 60 onto the tongue 65 and thus to the surface 16.

Figure 8:
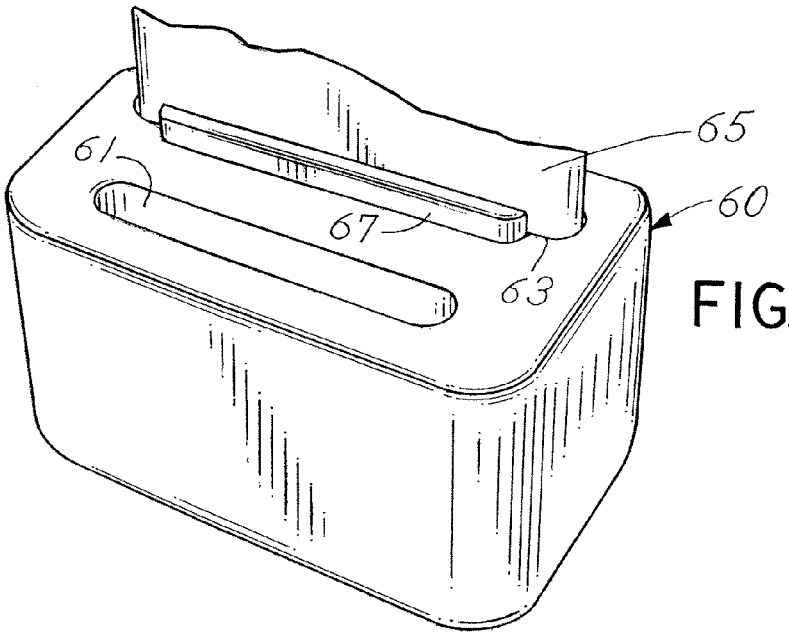
FIG. 8 depicts the exemplary tip of FIG. 7 being mounted to a surface of a tray or product channel.
Figure 15:
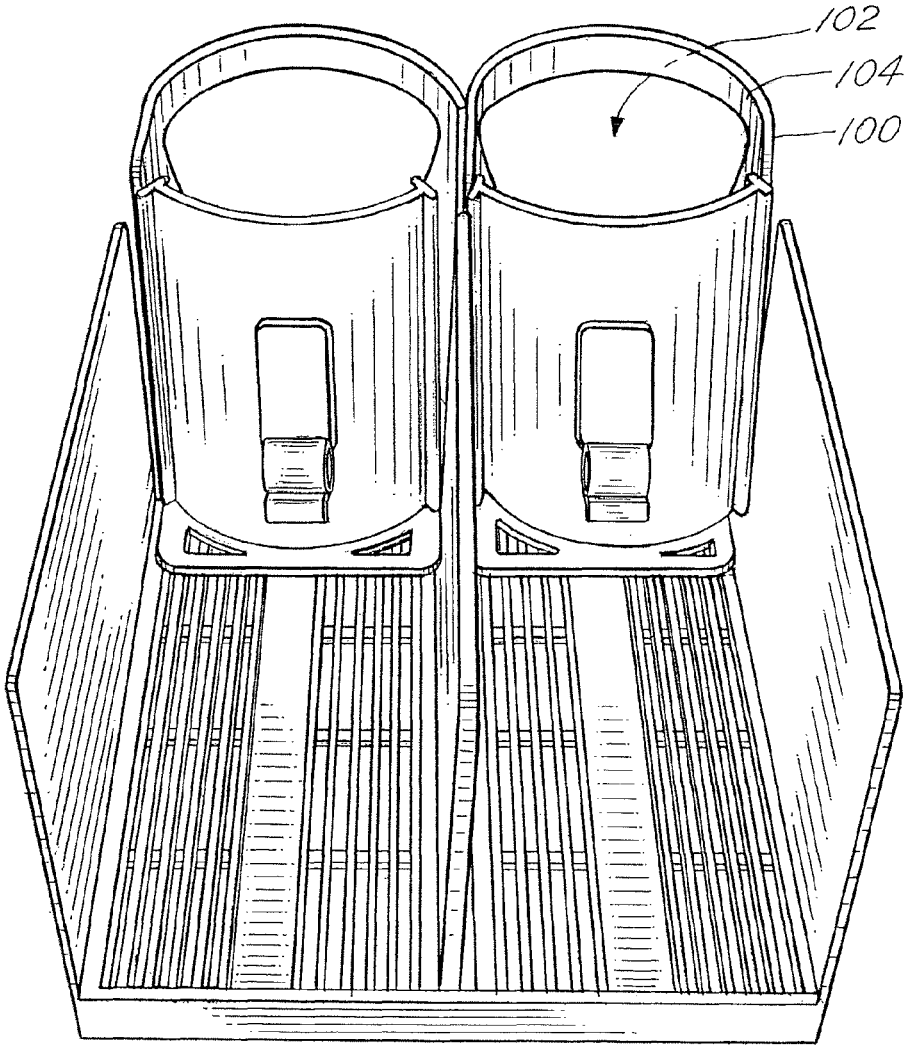
FIG. 15 depicts a back view of the system of FIG. 11.

Referring to FIG. 8, the exemplary tip 60 of FIG. 7 is shown being mounted to the tongue or mounting member 65. The tongue 65 may include an elongated outwardly extending rib 67 that is used to snap-fit the tip 60 onto the tongue 65. One skilled in the art will appreciate that other techniques may be used to mount the tip 60 to the surface 16 and that the depicted technique is merely an exemplary embodiment of one such technique.

Referring to FIG. 9, the exemplary tip 60 is shown fully mounted in a snap-fit manner to the surface 16, and more specifically to the end portion 24 of the surface 16 of the tray 12. Also depicted is the mounting of the end 29 of the coiled spring 30 to the aperture 61 of the tip 60. As shown in FIG. 9, the end 29 of the coiled spring may be inserted into the aperture 61. The aperture 61 is configured to receive the end 29 of the coiled spring and hold the end 29 in position, and to also permit the removal of the end 29 of the coiled spring from the aperture 61 in those circumstances where it is desirable to disconnect the coiled spring from the tip to permit the removal of the pusher mechanism 14 from the system.

Referring to FIG. 10 there is shown the end 29 of the coiled spring fully mounted to the exemplary tip 60. As illustrated in this figure, the coiled spring 30 is now operatively connected to the surface 16 of the tray 12. As a result, the pusher mechanism 14 is now mounted to the tray 12.

Referring to FIGS. 21-27 there is shown an alternative technique for mounting the end 29 of the coiled spring 30 to the merchandise display system. A mounting member 130 may be used to mount the end 29 of the coiled spring to the floor 131 of the system. For those systems that include spaced-apart glide rails 132 that are joined together by connecting ribs 134 (FIGS. 26-27), the mounting member 130 may be snap-fit to or otherwise mounted on the floor 131 and between the glide rails 132. The mounting member will thus hold the end of the coiled spring in position and to the floor of the system.

Figure 26:
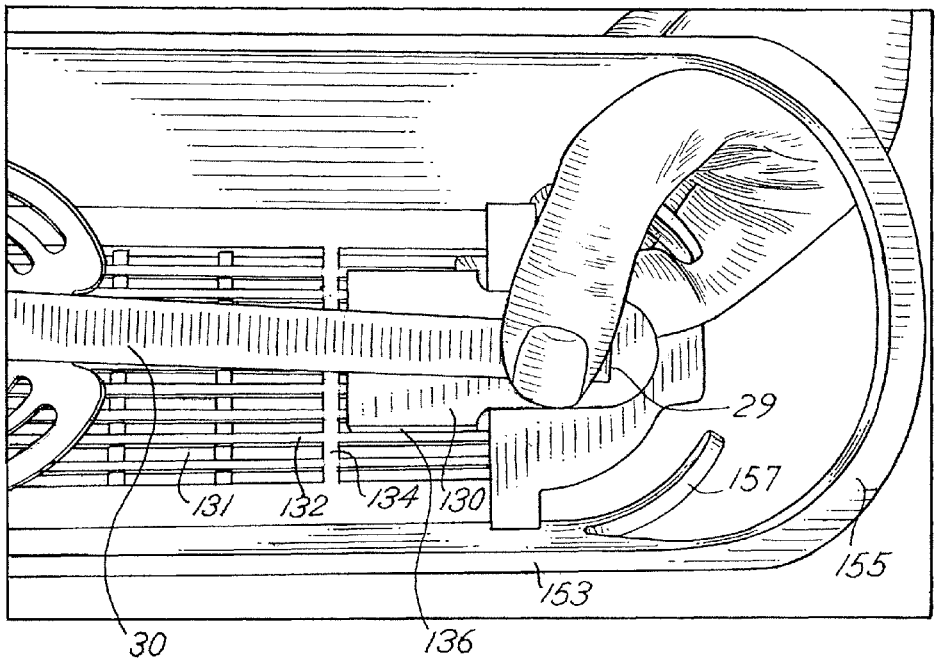
FIG. 26 depicts the exemplary mounting member of FIG. 22 with attached coiled spring being mounted to the floor of the system.
Figure 27:
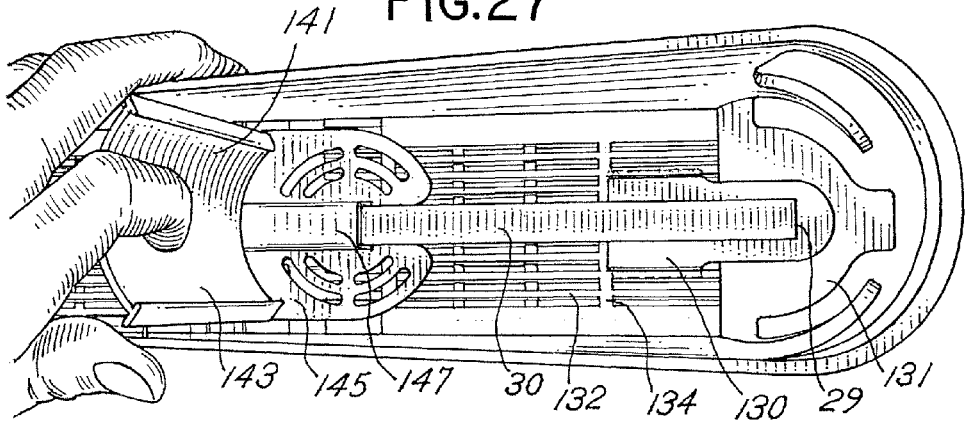
FIG. 27 depicts the exemplary mounting member of FIG. 22 installed on the floor of the system.

Referring to FIGS. 22-23, the mounting member 130 may include one or more legs 136 on one or more sides of the member 130. The legs may be configured to snap-fit to the underside of the rails 132 to thereby hold the mounting member 130 to the floor of the system. The legs 136 may include legs ends 137 defining an L-shape or angled surfaces that are configured to contact the underside of the rail 132 and prevent the mounting member 130 from being lifted up from the floor, except by the intentional flexing of the legs out from the underside of the rail 132. The legs 136 may contact the connecting ribs 134 which will prevent slidable movement of the mounting member 130 relative to the floor. Referring to FIG. 26, the mounting member 130 is shown being mounted to the floor of the system and more specifically to the rails. FIG. 27 illustrates that the mounting member 130 remains in position as the pusher paddle 141 is pulled away from the front of the system. The mounting member 130 may be connected to this type of system floor 131 using other techniques. For example, a separate mounting clip, one or more fasteners, adhesives, or other techniques may be used to secure the mounting member 130 to the floor 131.

Referring to FIGS. 22-23, the mounting member 130 may also include an aperture or opening or slot 138 that will receive the end 29 of the spring. The spring may be mounted using any of the techniques described herein, or other techniques. The configuration of the aperture 138 and mounting member 130 will hold the spring in position on the mounting member 130, similar to the technique described above.

The mounting member 130 may also include glide ribs 139 on a top surface that allow product placed thereon to slide more easily across the mounting member after the mounting member is installed to the floor of the system. The mounting member 130 may also include an elongated flat body 140 that extends forward of the location of the legs 136 to provide stability to the mounting member 130 after it is mounted to the floor of the system.

Figure 24:
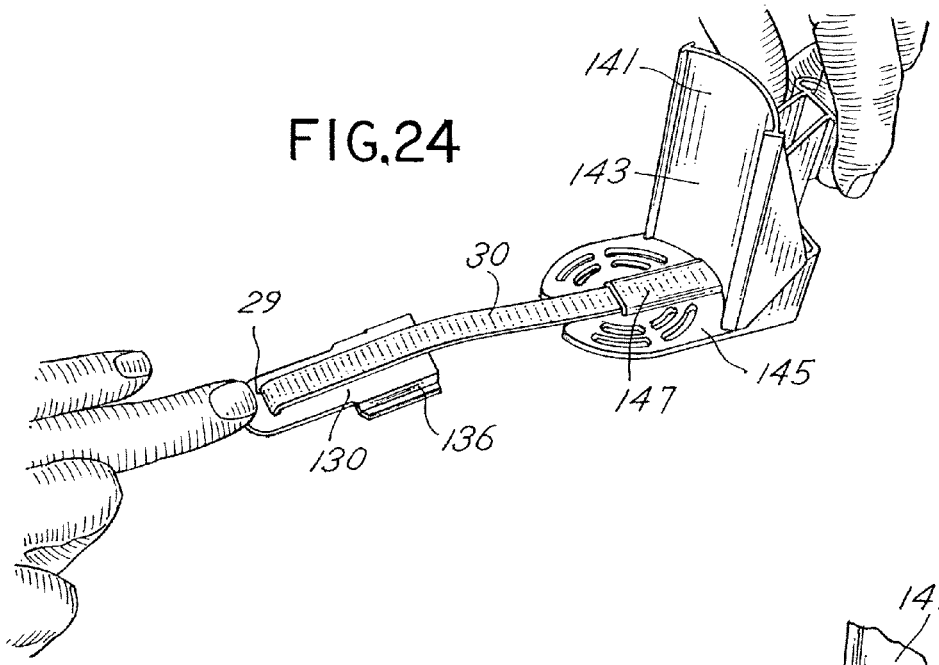
FIG. 24 depicts the exemplary mounting member of FIG. 22 mounted to the end of the coiled spring with the coiled spring mounted to an exemplary pusher paddle.
Figure 25:
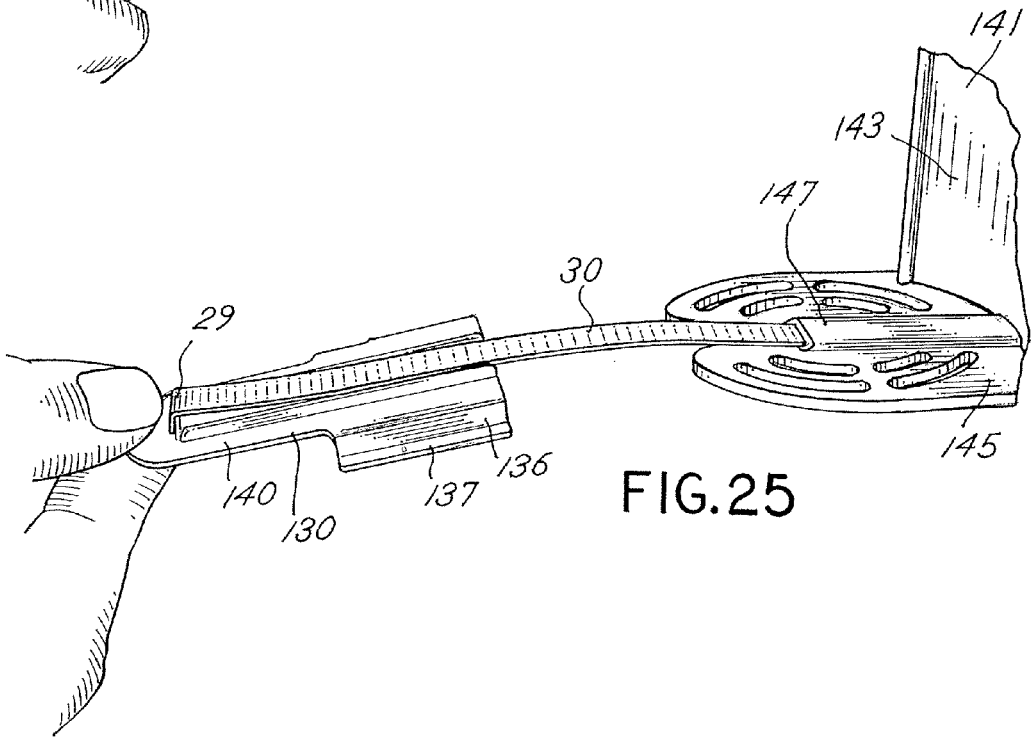
FIG. 25 depicts another view of the exemplary mounting member of FIG. 22 mounted to the end of the coiled spring with the coiled spring mounted to an exemplary pusher paddle.

Referring to FIGS. 24-25 and 27, the pusher paddle or pusher mechanism 141 may include a pusher face 143 configured to match the shape of the product against which it pushes. As illustrated, the pusher face 143 may be curve shaped to match the shape of a bottle or other cylindrical object. The pusher paddle 141 may also include a pusher floor 145 similar to the pusher floor configurations described above. The pusher floor 145 may further include a spring sleeve 147 that receives the coiled spring 30 to shield and protect the spring. The spring sleeve 147 may extend partly or fully across the pusher floor 145 and in the direction of the spring 30. The spring sleeve 147 may have a relatively short height and a flat surface 149 to permit product to sit thereon without significant tipping or leaning of the product.

The pusher paddle 141 may be positioned on top of the floor 131 to glide on top of the surface, as describe above. The pusher paddle may be positioned between two product divider walls 153 that are joined together by a product retaining member 155. Additional product retaining members 157 may extend outwardly from the product dividers.

Referring to FIGS. 28 and 29 there is shown yet another alternative technique for mounting the end 29 of the coiled spring 30 to the merchandise display system. In this embodiment, the end 29 is riveted to the tray 216.

Referring to FIGS. 28-32 in an alternative embodiment, the trackless pusher system may be retrofitted to an existing shelf assembly 230, which may have product dividers already built in. For example, in one embodiment, the trackless pusher system may be retrofitted to an existing wire shelf assembly. Referring to FIGS. 30-32, a tray or adaptor 216 may have a glide floor 222 that may be sized to a single lane of the shelf 234 or sized to an entire shelf width. The glide floor 222 may include several raised ribs 224, which help to reduce friction for the products merchandised on the tray 216. It should be understood that one or more raised ribs 224 may be used with the glide floor 222. Alternatively, the glide floor 222 may be a flat, planar surface without raised ribs. The tray or adaptor 216 may be configured similar to the adaptor 180 of FIG. 16.

As shown in FIGS. 28 and 30, the end 29 of coiled spring 30 may be riveted, via a rivet 229, to the front end 228 of the tray 216, or may be attached by any other attachment technique. The tray 216 can be retained to the shelf by any attachment technique suitable for the particular shelf. In one embodiment, and as illustrated in FIGS. 29-32, the tray 216 may include one or more outwardly extending fingers or snaps 220, which may engage one or more individual wires 232 of the shelf 234 to retain the tray 216 on the shelf 234. The fingers or snaps 220 may extend longitudinally along the length of the tray 216, or may be spaced apart along the length of the tray. The snaps 220 may be used to snap-fit the tray 216 to the existing wire shelf. As depicted in FIGS. 29A and 29B, the snaps 220A and 220B may define numerous configurations that permit the tray 216 to be snap fit to the shelf. The embodiment depicted in FIGS. 28-32 allows for the placement of the trackless pusher system in an existing shelving system, such as a wire shelf system, as a low cost alternative to the entire trackless pusher assembly. It should be understood that with this embodiment, any pusher mechanism described herein may be used.

Variations and modifications of the foregoing are within the scope of the present invention. For example, one of skill in the art will understand that multiples of the described components may be used in stores and in various configurations. The present invention is therefore not to be limited to the single system 10, nor the upright pusher configuration, depicted in the Figures, as the system 10 is simply illustrative of the features, teachings and principles of the invention. It should further be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A product management display system comprising:

a tray defining a top surface and an underside surface, the tray formed by a plurality of rails joined by a plurality of ribs, a coiled spring, a pusher mechanism that sits on top of and does not extend below the tray top surface, wherein the pusher mechanism is mounted to the underside surface of the tray only by the coiled spring, the pusher mechanism including a pusher surface and a pusher floor extending forwardly from the pusher surface, wherein during operation of the pusher mechanism the pusher floor is configured to permit at least one product to sit upon the pusher floor, and the pusher floor is glidable across the top surface of the tray, the coiled spring defining a first end and a coiled second end and extendable across at least a portion of the tray top surface, the first end of the coiled spring mounted to the underside surface of the tray, the second coiled end positioned behind the pusher surface, and at least one divider extending upwardly from the tray for dividing displayed product into rows.

2. The product management display system of claim 1, further comprising a mounting member mountable to the tray surface, wherein the mounting member defines a slot for receiving the first end of the coiled spring.

3. The product management display system of claim 2, wherein the mounting member defines at least one leg for snap-fitting the mounting member to the rails of the tray surface.

4. The product management display system of claim 3, wherein the mounting member is positioned between the plurality of rails and the plurality of ribs.

5. The product management display system of claim 4, wherein the at least one leg is L-shaped to permit the leg to snap fit to the plurality of rails.

6. The product management display system of claim 2, wherein the mounting member defines two opposing legs for snap-fitting the mounting member to the rails of the tray surface.

7. The product management display system of claim 6, wherein the mounting member includes at least one glide rail across a surface of the mounting member.

8. The product management display system of claim 1, wherein the pusher floor extends perpendicularly outward from the pusher surface.

9. The product management display system of claim 4, wherein the pusher surface is curve shaped.

10. The product management display system of claim 1, wherein the pusher floor further includes a spring sleeve for receiving the coiled spring.

11. The product management display system of claim 10, wherein the spring sleeve extends across the pusher floor.

12. The product management display system of claim 1, further comprising a retaining member extending outwardly from the at least one divider.

13. The product management display system of claim 12, further comprising multiple retaining members extending outwardly from the at least one divider.

14. The product management display system of claim 1, wherein the coiled spring is extendable beneath the pusher floor surface.

15. The product management display system of claim 1, wherein the coiled spring is extendable above the pusher floor surface.

16. A product management display system comprising:

a tray defining a top surface and an underside surface, a coiled spring, and a pusher mechanism that sits on top of and does not extend below the tray top surface, wherein the pusher mechanism is glidable across the tray top surface and is mounted to and held onto the tray only by the coiled spring, the pusher mechanism including a pusher surface and a pusher floor extending forwardly from the pusher surface, wherein the pusher floor is configured to permit at least one product to sit upon the pusher floor during operation of the pusher mechanism, the coiled spring defining a first end and a coiled second end, the first end of the coiled spring mounted to the tray, the second coiled end positioned behind the pusher surface, and at least one divider extending upwardly from the tray for dividing displayed product into rows.

17. The product management display system of claim 16, wherein the tray is formed by a plurality of rails joined by a plurality of ribs.

18. The product management display system of claim 17, wherein the first end of the coiled spring connects to at least one of the plurality of ribs.

19. The product management display system of claim 18, wherein two dividers extend upwardly from the tray on opposing sides of the tray.

20. The product management display system of claim 19, further comprising a product retaining member extending between the two dividers.

21. The product management display system of claim 20, wherein the pusher floor defines a periphery that further defines first and second curve-shaped periphery portions and a notch located between the first and second curve-shaped periphery portions.

22. The product management display system of claim 21, wherein the pusher floor defines at least one aperture extending through the pusher floor.

23. A product management display system comprising:

a plurality of trays, each tray defining a top surface and an underside surface, a pusher mechanism that is glidable across the top surface of one of the plurality of trays, the pusher mechanism including a pusher surface and a pusher floor extending forwardly from the pusher surface, wherein during operation of the pusher mechanism the pusher floor is configured to glide across the top surface of the one of the plurality of trays, and wherein the pusher mechanism is entirely above the one of the plurality of the trays during operation of the pusher mechanism, a coiled spring that holds the pusher mechanism to the one of the plurality of trays, the coiled spring defining a first end and a coiled second end and extendable across at least a portion of the one of the plurality of the trays, the first end of the coiled spring mounted to the one of the plurality of the trays, the second coiled end positioned behind the pusher surface, and at least one divider extending upwardly from the one of the plurality of the trays for dividing displayed product into rows.

24. The product management display system of claim 23, wherein each tray is formed by a plurality of rails joined by a plurality of ribs.

25. The product management display system of claim 24, wherein the first end of the coiled spring connects to at least one of the plurality of ribs.

26. The product management display system of claim 23, wherein the pusher floor defines a periphery that further defines first and second curve-shaped periphery portions and a notch located between the first and second curve-shaped periphery portions.

27. The product management display system of claim 26, wherein two dividers extend upwardly from each tray on opposing sides of the tray.

28. The product management display system of claim 27, further comprising a product retaining member connected to and extending between the two dividers.

29. The product management display system of claim 26, wherein the pusher floor defines at least one aperture extending through the pusher floor.

30. The product management display system of claim 23, wherein the plurality of trays are positioned adjacent to each other and joined together.

31. The product management display system of claim 23, wherein the first end of the coiled spring is mounted directly to the tray.

32. The product management display system of claim 23, wherein the first end of the coiled spring is mounted at a forward position on the tray.

33. The product management display system of claim 23, wherein the first end of the coiled spring is mounted to the tray through the use of a spring tip.

* * * * *